US008547193B2

(12) United States Patent
Kainaga et al.

(10) Patent No.: US 8,547,193 B2
(45) Date of Patent: Oct. 1, 2013

(54) STATIONARY INDUCTION APPARATUS

(75) Inventors: Soichiro Kainaga, Tokyo (JP); Takao Tsurimoto, Tokyo (JP); Takahiko Ishikura, Tokyo (JP); Hirotaka Muto, Tokyo (JP); Hiroki Otera, Tokyo (JP); Tetsuya Matsuda, Tokyo (JP); Koji Kise, Tokyo (JP); Noboru Hosokawa, Tokyo (JP); Kiyoyuki Ishikawa, Tokyo (JP); Koji Shinya, Tokyo (JP); Ryuichi Nishiura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 13/394,222

(22) PCT Filed: Oct. 18, 2010

(86) PCT No.: PCT/JP2010/068265

§ 371 (c)(1),
(2), (4) Date: Mar. 5, 2012

(87) PCT Pub. No.: WO2011/049041

PCT Pub. Date: Apr. 28, 2011

(65) Prior Publication Data

US 2012/0161912 A1 Jun. 28, 2012

(30) Foreign Application Priority Data

Oct. 21, 2009 (JP) ..... 2009-242675
Mar. 26, 2010 (JP) ..... 2010-072899

(51) Int. Cl.
*H01F 27/08* (2006.01)
*H01F 27/06* (2006.01)

(52) U.S. Cl.
USPC ..... 336/60; 336/61; 336/65

(58) Field of Classification Search
USPC ..... 336/60, 61, 65, 68; 310/12.21, 12.22, 310/12.25, 52, 58, 59, 60 A
See application file for complete search history.

(56) References Cited

U.S. PATENT DOCUMENTS 3,242,447 A * 3/1966 Diebold ..... 336/160
4,000,482 A * 12/1976 Staub et al. ..... 336/60
5,588,201 A * 12/1996 Alber et al. ..... 29/605
6,265,793 B1 * 7/2001 Korenaga ..... 310/12.06
6,791,670 B2 * 9/2004 Miyajima et al. ..... 355/72

(Continued)

FOREIGN PATENT DOCUMENTS

JP 53 37815 4/1978
JP 54-026623 2/1979

(Continued)

OTHER PUBLICATIONS

International Search Report issued on Dec. 7, 2010 in PCT/JP10/068265 filed on Oct. 18, 2010.

(Continued)

*Primary Examiner* — Lincoln Donovan
*Assistant Examiner* — Joselito Baisa
(74) *Attorney, Agent, or Firm* — Oblon, Spivak, McClelland, Maier & Neustadt, L.L.P.

(57) ABSTRACT

In a stationary induction apparatus, an inter-partial-coil insulating plate and a plurality of inter-partial-coil spacer insulators form a refrigerant flow path in conjunction with each other. A space having an inter-partial-coil insulation dimension for withstanding an abnormal voltage is formed between a pair of partial coils. The inter-partial-coil insulating plate and the inter-partial-coil spacer insulators support both the pair of partial coils at an insulated state so as to maintain the inter-partial-coil insulation dimension. The insulators are arranged so as to be overlapped with each other in the direction in which mutually adjacent partial coils are opposed to each other.

10 Claims, 16 Drawing Sheets

(56) References Cited

U.S. PATENT DOCUMENTS

| | | | | |
|---|---|---|---|---|
| 7,282,821 | B2 * | 10/2007 | Kubo et al. | 310/12.15 |
| 7,301,602 | B2 * | 11/2007 | Sato et al. | 355/30 |
| 7,647,692 | B2 * | 1/2010 | Lanoue et al. | 29/609 |
| 8,022,798 | B2 * | 9/2011 | Damiani et al. | 335/216 |

FOREIGN PATENT DOCUMENTS

| | | |
|---|---|---|
| JP | 58 144814 | 9/1983 |
| JP | 59 61109 | 4/1984 |
| JP | 60 119726 | 8/1985 |
| JP | 63 152222 | 10/1988 |
| JP | 10 172824 | 6/1998 |

OTHER PUBLICATIONS

Office Action issued Apr. 30, 2013, in Japanese Patent Application No. 2011-537236 (with English-language Translation).

* cited by examiner

STATIONARY INDUCTION APPARATUS

TECHNICAL FIELD

The present invention relates to a stationary induction apparatus having a structure for insulating, cooling, and supporting coils, which is used, for example, for an oil-filled transformer, an oil-filled reactor, and the like.

BACKGROUND ART

For example, in a conventional apparatus as disclosed in Patent Literature 1, a plurality of cylindrical winding layers are overlaid to form a multilayer cylindrical winding. Between adjacent cylindrical winding layers, there is provided an interlayer insulator for insulating the cylindrical winding layers. In addition, each cylindrical winding layer of the multilayer cylindrical winding (partial coil assembly) is constituted of a plurality of part windings (partial coils). The plurality of part windings are connected in parallel. Further, between adjacent part windings, there is formed a refrigerant flow path for cooling oil (refrigerant) to flow.

Further, for example, in a conventional apparatus disclosed in Patent Literature 2, a plurality of spacing pieces are disposed with spaces between adjacent metal sheets. By the plurality of spacing pieces, the refrigerant flow path is formed between the adjacent metal sheets.

CITATION LIST

Patent Literature

PTL 1: JP 59-61109 A
PTL 2: JP 63-152222 U

SUMMARY OF INVENTION

Technical Problem

In the conventional apparatus disclosed in Patent literature 1, because a structure of each of the plurality of part windings is a single-side cooling structure, sufficient cooling performance cannot be secured.

In addition, in the conventional apparatus disclosed in Patent literature 2, the spacing pieces are disposed between the adjacent metal sheets. On the other hand, there is no structure for supporting the metal sheets between the spacing pieces. Therefore, when a short-circuit electromagnetic force is applied between the metal sheets, deformation and displacement may occur in the metal sheet at a place between the spacing pieces. In addition to this, when a short-circuit electromagnetic force is applied between the metal sheets, displacement of the spacing piece itself may occur.

The present invention has been made to solve the above-mentioned problem, and an object thereof is to provide a stationary induction apparatus that can enhance cooling performance of the partial coil and can suppress occurrence of deformation and displacement of the partial coil when a short-circuit electromagnetic force is applied to the partial coil.

Solution to Problem

An stationary induction apparatus according to the present invention includes: a partial coil assembly constituted of a plurality of partial coils disposed to be opposed and to overlap with each other; refrigerant flow paths formed on both sides of each of the plurality of partial coils; and an inter-partial-coil supporting portion that is disposed between adjacent partial coils to cover the entire overlapping region between the adjacent partial coils, supports each of the adjacent partial coils in an insulated state so that a space is secured between the adjacent partial coils, and forms one of the refrigerant flow paths between the adjacent partial coils.

DESCRIPTION OF EMBODIMENTS

Hereinafter, embodiments of the present invention are described with reference to the drawings.

First Embodiment

Figure 1:
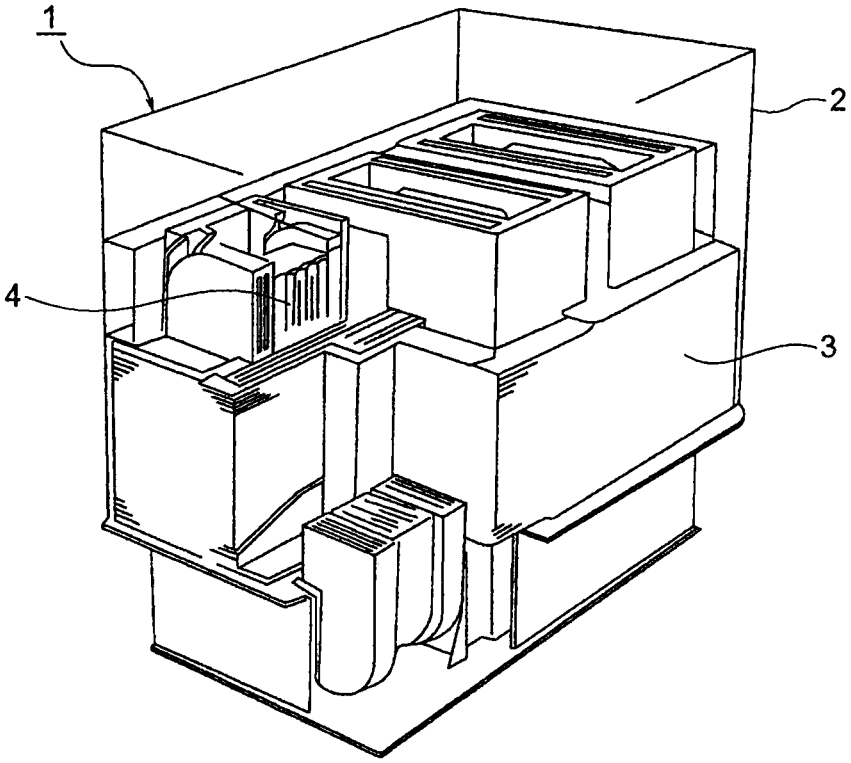
FIG. 1 is a perspective view illustrating a shell type transformer according to a first embodiment of the present invention.
Figure 2:
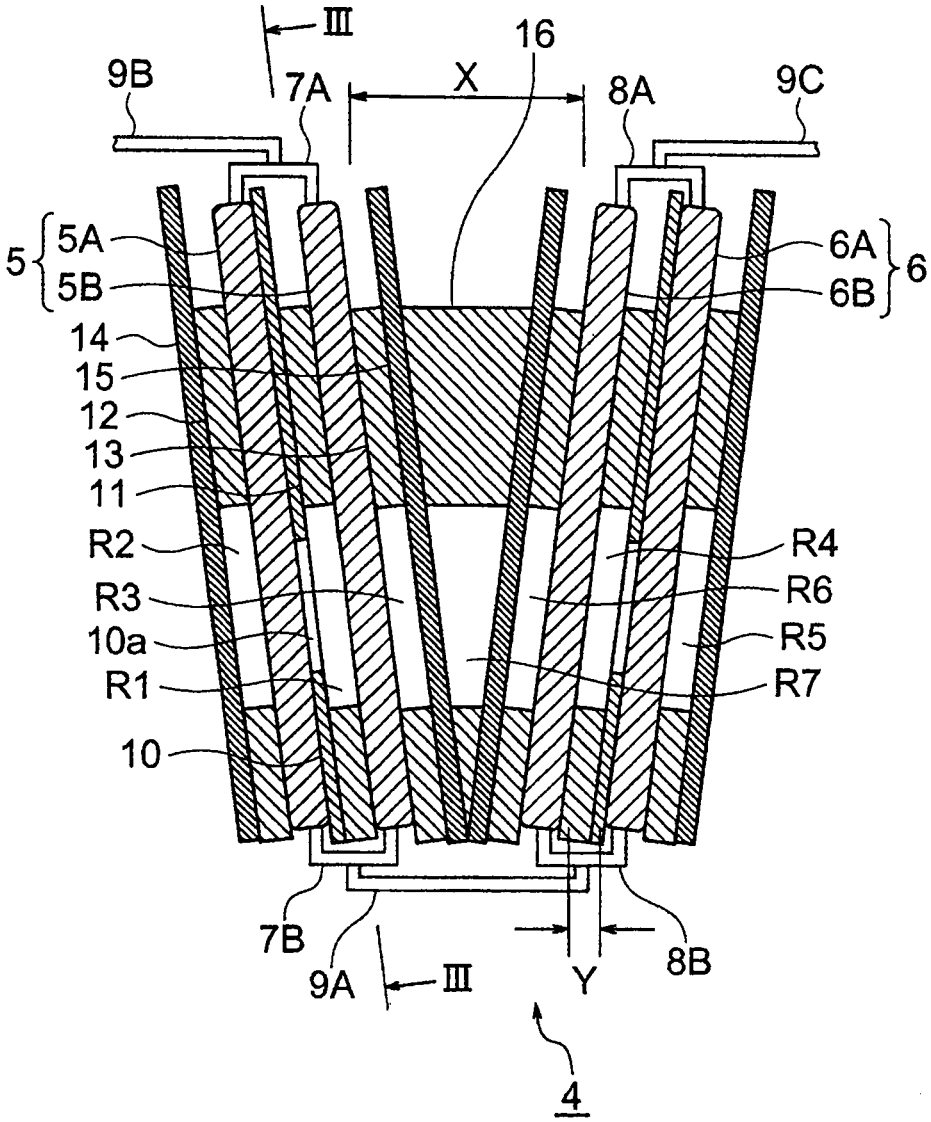
FIG. 2 is a cross-sectional view illustrating a part of a coil body of FIG. 1 in an enlarged manner.
Figure 3:
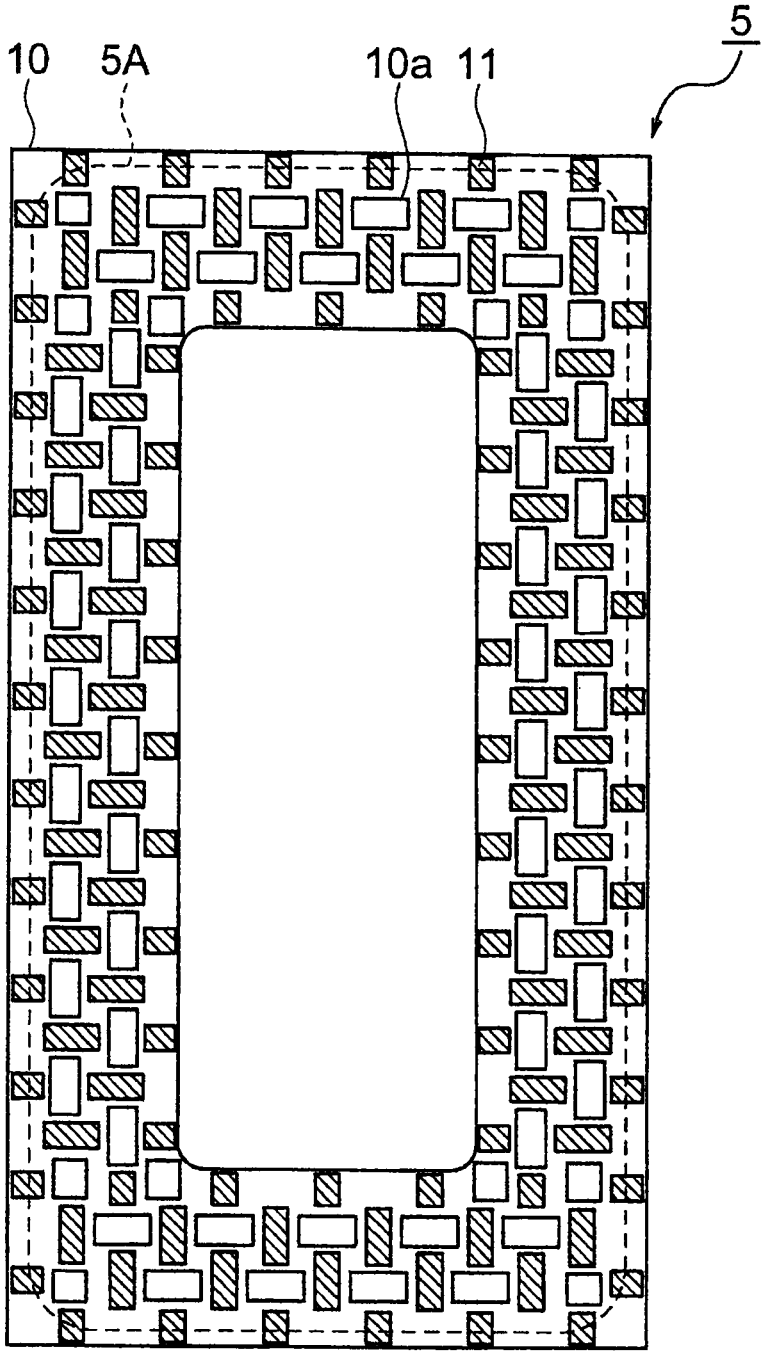
FIG. 3 is a cross-sectional view taken along line III-III of FIG. 2.

FIG. 1 is a perspective view illustrating a shell type transformer 1 according to a first embodiment of the present invention. FIG. 2 is a cross-sectional view illustrating a part of a coil body 4 of FIG. 1 in an enlarged manner. FIG. 3 is a cross-sectional view taken along line III-III of FIG. 2. Note that, in FIG. 1, parts of a tank 2, a core 3, and the coil body 4 are illustrated by a cross section. In addition, the upper side of FIG. 2 is an outer periphery side of the coil body 4 while the lower side of FIG. 2 is an inner circumference side of the coil body 4.

In FIGS. 1 to 3, the shell type transformer 1 as a stationary induction apparatus includes the tank 2, the core 3, and a plurality of the coil bodies 4. Cooling oil (refrigerant; not shown) is filled in the tank 2. The core 3 and the coil body 4 are housed inside the tank 2. The coil body 4 is attached so as to surround a leg portion (center shaft) of the core 3. In addition, the coil body 4 is a coil having a rectangular flat plate shape disposed so that the longitudinal direction thereof is vertical.

The coil body 4 includes a first partial coil assembly 5 and a second partial coil assembly 6. The first partial coil assembly 5 is constituted of a set of partial coils 5A and 5B. The second partial coil assembly 6 is also constituted of a set of partial coils 6A and 6B in the same manner. Each of the partial coils 5A, 5B, 6A, and 6B is formed like a flat plate with wiring wound in a flat plate shape.

The outer periphery side and the inner circumference side of the coil body 4 in the partial coils 5A and 5B are short-circuited via a partial coil connection wires 7A and 7B. In other words, the partial coils 5A and 5B are connected in parallel via the partial coil connection wires 7A and 7B. Similarly to this, the partial coils 6A and 6B are connected in parallel via the partial coil connection wires 8A and 8B.

The inner circumference sides (lower side of FIG. 2) of the coil bodies 4 in the first partial coil assembly 5 and the second partial coil assembly 6 are connected in series via a coil connection wire 9A. In addition, an inter-coil insulation dimension X is set at the outer periphery sides (upper side of FIG. 2) of the coil bodies 4 in the first partial coil assembly 5 and the second partial coil assembly 6 so as to withstand a high voltage generated when a high frequency high voltage such as impulse voltage is applied to the shell type transformer 1.

The first partial coil assembly 5 and a coil assembly (not shown) disposed adjacent to the first partial coil assembly 5 on the opposite side (left side of FIG. 2) to the second partial coil assembly 6 are connected in series via a coil connection wire 9B on the outer periphery side of the coil body 4. Similarly to this, the second partial coil assembly 6 and a coil assembly (not shown) disposed adjacent to the second partial coil assembly 6 on the opposite side (right side of FIG. 2) to the first partial coil assembly 5 are connected in series via a coil connection wire 9C on the outer periphery side of the coil body 4.

Therefore, the partial coils 5A, 5B, 6A, and 6B are connected in parallel to constitute the first and second partial coil assemblies 5 and 6, and the like, which are connected in series to constitute the coil body 4 as a whole. In other words, the coil body 4 is constituted of the plurality of partial coils 5A, 5B, 6A, 6B, and the like that are disposed to be opposed and overlapped with each other in the axial direction.

Between the adjacent partial coils 5A and 5B, there is disposed an inter-partial-coil insulating plate 10 having a flat plate shape as an inter-partial-coil supporting portion. The inter-partial-coil insulating plate 10 is disposed to cover the entire region in which the partial coils 5A and 5B are overlapped as illustrated in FIG. 3. In addition, one surface (surface on the left side of FIG. 2; surface on the back side of FIG. 3: first surface) of the inter-partial-coil insulating plate 10 is disposed to contact with a surface of the partial coil 5A on the partial coil 5B side (surface on the right side of FIG. 2).

On the other surface of the inter-partial-coil insulating plate 10 (surface on the right side of FIG. 2; surface on the front side of FIG. 3: second surface), there are attached a plurality of inter-partial-coil spacer insulators 11 as inter-partial-coil protrusions with spaces by adhesive or the like, for example. The plurality of inter-partial-coil spacer insulators 11 are disposed between the inter-partial-coil insulating plate 10 and the partial coil 5B. A space between the adjacent inter-partial-coil spacer insulators 11 in a region between the inter-partial-coil insulating plate 10 and the partial coil 5B is a refrigerant flow path (oil flow path) R1. In other words, the inter-partial-coil insulating plate 10 and the plurality of inter-partial-coil spacer insulators 11 form the refrigerant flow path R1 together.

Between the adjacent inter-partial-coil spacer insulators 11 in the inter-partial-coil insulating plate 10, there is disposed an opening 10*a*. The opening 10*a* communicates to the refrigerant flow path R1. Thus, a portion of the partial coil 5A adjacent to the opening 10*a* is exposed to the refrigerant flow path R1. In other words, the opening 10*a* guides the refrigerant flowing in the refrigerant flow path R1 to the partial coil 5A.

On one of outer surfaces of the first partial coil assembly 5, namely on the surface of the partial coil 5A opposite to the inter-partial-coil insulating plate 10 (surface on the left side of FIG. 2), there is disposed a first outer insulating plate 14 to be opposed to the partial coil 5A with a space from the same. On a surface of the first outer insulating plate 14 on the partial coil 5A side, there are disposed a plurality of first outer spacer insulators 12 with spaces by adhesive or the like, for example.

The plurality of first outer spacer insulators 12 are disposed between the first outer insulating plate 14 and the partial coil 5A. A space between the adjacent first outer spacer insulators 12 in a region between the first outer insulating plate 14 and the partial coil 5A is a refrigerant flow path R2. In other words, the first outer insulating plate 14 and the plurality of first outer spacer insulators 12 form the refrigerant flow path R2 together.

On the other outer surface of the first partial coil assembly 5, namely on the surface of the partial coil 5B on the opposite side to the partial coil 5A (surface on the right side of FIG. 2), there is disposed a second outer insulating plate 15 to be opposed to the partial coil 5B with a space from the same. On a surface of the second outer insulating plate 15 on the partial coil 5B side, there are disposed a plurality of second outer spacer insulators 13 with spaces therebetween.

The plurality of second outer spacer insulators 13 are disposed between the second outer insulating plate 15 and the partial coil 5B. A space between the adjacent first outer spacer insulators 13 in a region between the second outer insulating plate 15 and the partial coil 5B is a refrigerant flow path R3. In other words, the second outer insulating plate 15 and the plurality of second outer spacer insulators 13 form the refrigerant flow path R3 together.

As to the second partial coil assembly 6 too, similarly to the first partial coil assembly 5, there are disposed insulating plates similar to the inter-partial-coil insulating plate 10 and the first and second outer insulating plates 14 and 15, and insulators similar to the inter-partial-coil spacer insulator 11 and the first and second outer spacer insulators 12 and 13. In the second partial coil assembly 6, there are formed a plurality of refrigerant flow paths R4 to R6 by the insulating plates and the insulators.

Between the first partial coil assembly 5 and the second partial coil assembly 6 (between the outer insulating plates), there are disposed a plurality of inter-coil-assembly insulators 16 with spaces. A plurality of inter-coil-assembly insulators 16 form a refrigerant flow path R7 together between the first partial coil assembly 5 and the second partial coil assembly 6. Note that, the insulating plates 10, 14, and 15 and insulators 11, 12, 13, and 16 may be made of pressboard, a resin molded component, a mixture of resin and paper, or the like, for example.

Here, when a high frequency high voltage such as an impulse voltage is applied to the shell type transformer 1, high voltages are generated between the partial coils 5A and 5B and between the partial coils 6A and 6B, respectively. Therefore, inter-partial-coil insulation dimension Y is formed between the partial coils 5A and 5B, and between the partial coils 6A and 6B, respectively for withstanding the generated voltages. As to the inter-partial-coil insulating plate 10 and the plurality of inter-partial-coil spacer insulators 11, both the partial coils 5A and 5B are supported in an insulated state so as to secure the inter-partial-coil insulation dimension Y.

In addition, the insulators 11, 12, 13, and 16 are disposed to overlap with each other in the direction in which the partial coils 5A and 5B are opposed to each other. In other words, the insulators 11, 12, 13, and 16 are disposed to be the same position in the coil surface of the coil body 4 (the surface parallel to the surface perpendicular to the axial direction of the leg portion of the core 3).

According to the above-mentioned shell type transformer 1 of the first embodiment, the inter-partial-coil insulating plate 10 and the plurality of inter-partial-coil spacer insulators 11 are disposed between the partial coils 5A and 5B so as to cover the entire region in which the partial coils 5A and 5B overlap with each other. The inter-partial-coil insulating plate 10 and the plurality of inter-partial-coil spacer insulators 11 support the partial coils 5A and 5B so as to maintain the space between the partial coils 5A and 5B and form the refrigerant flow path R1 between the partial coils 5A and 5B. With this structure, the partial coils 5A and 5B can be cooled from both sides so that cooling performance of the partial coils 5A and 5B can be enhanced more than the conventional apparatus. In addition to this, when a short-circuit electromagnetic force is applied to the partial coils 5A and 5B, it is possible to suppress occurrence of deformation and displacement of partial coils 5A and 5B. Note that, as to the partial coils 6A and 6B too, similarly to the partial coils 5A and 5B, occurrence of deformation and displacement of the partial coils 6A and 6B can be suppressed by the inter-partial-coil insulating plate and the plurality of inter-partial-coil spacer insulators.

In addition, the plurality of inter-partial-coil spacer insulators 11 are attached to only one surface (first surface) of the inter-partial-coil insulating plate 10, and the inter-partial-coil insulating plate 10 and the plurality of inter-partial-coil spacer insulators 11 form the refrigerant flow path R1. Thus, the number of components becomes smaller than that in the structure in which spacer insulators are attached to both surfaces of the inter-partial-coil insulating plate so as to form the refrigerant flow path (for example, the structure of a second embodiment described later). In addition to this, in the structure of the first embodiment, the width of the refrigerant flow path becomes larger than that in the structure in which the refrigerant flow path is split to both sides of the inter-partial-coil insulating plate. Therefore, compared with the case where the refrigerant flow path is split to both sides of the inter-partial-coil insulating plate, a pressure loss of the cooling oil is decreased so that a flow rate of the cooling oil is increased. Thus, circulation efficiency of the cooling oil is improved.

Further, the insulators 11, 12, 13, and 16 are disposed to overlap each other in the direction in which the partial coils 5A and 5B are opposed to each other (in the axial direction of the coil body 4). With this structure, when the short-circuit electromagnetic force is applied to the partial coils 5A and 5B, mechanical power due to the short-circuit electromagnetic force is linearly transmitted and dispersed to the insulators 11, 12, 13, and 16. Therefore, occurrence of deformation and displacement of the partial coils 5A and 5B can be suppressed more strongly, and the partial coils 5A and 5B can be supported more securely.

In addition, the opening 10*a* communicating to the refrigerant flow path R1 formed between the partial coils 5A and 5B is disposed in the inter-partial-coil insulating plate 10. With this structure, because the partial coil 5A adjacent to the inter-partial-coil insulating plate 10 can also contact with the cooling oil via the opening 10*a*, cooling performance can be improved.

Further, the plurality of inter-partial-coil spacer insulators 11 are attached to the inter-partial-coil insulating plate 10. With this structure, when the shell type transformer 1 is manufactured, the inter-partial-coil spacer insulators 11 are attached to the inter-partial-coil insulating plate 10 to be integrated, and after that the integrated matter can be inserted into between the partial coils 5A and 5B. Thus, manufacturing steps of the shell type transformer 1 can be simplified. In addition to this, even if a mechanical power due to vibration of the partial coils 5A and 5B or the short-circuit electromagnetic force is applied to the inter-partial-coil spacer insulators 11, displacement or the like of the inter-partial-coil spacer insulators 11 is not generated so that a support structure with high reliability can be obtained.

Second Embodiment

In the first embodiment, the inter-partial-coil spacer insulators 11 are attached to one side of the inter-partial-coil insulating plate 10. In contrast to this, in the second embodiment, inter-partial-coil spacer insulators 21 and 22 are attached to both sides of an inter-partial-coil insulating plate 20.

Figure 4:
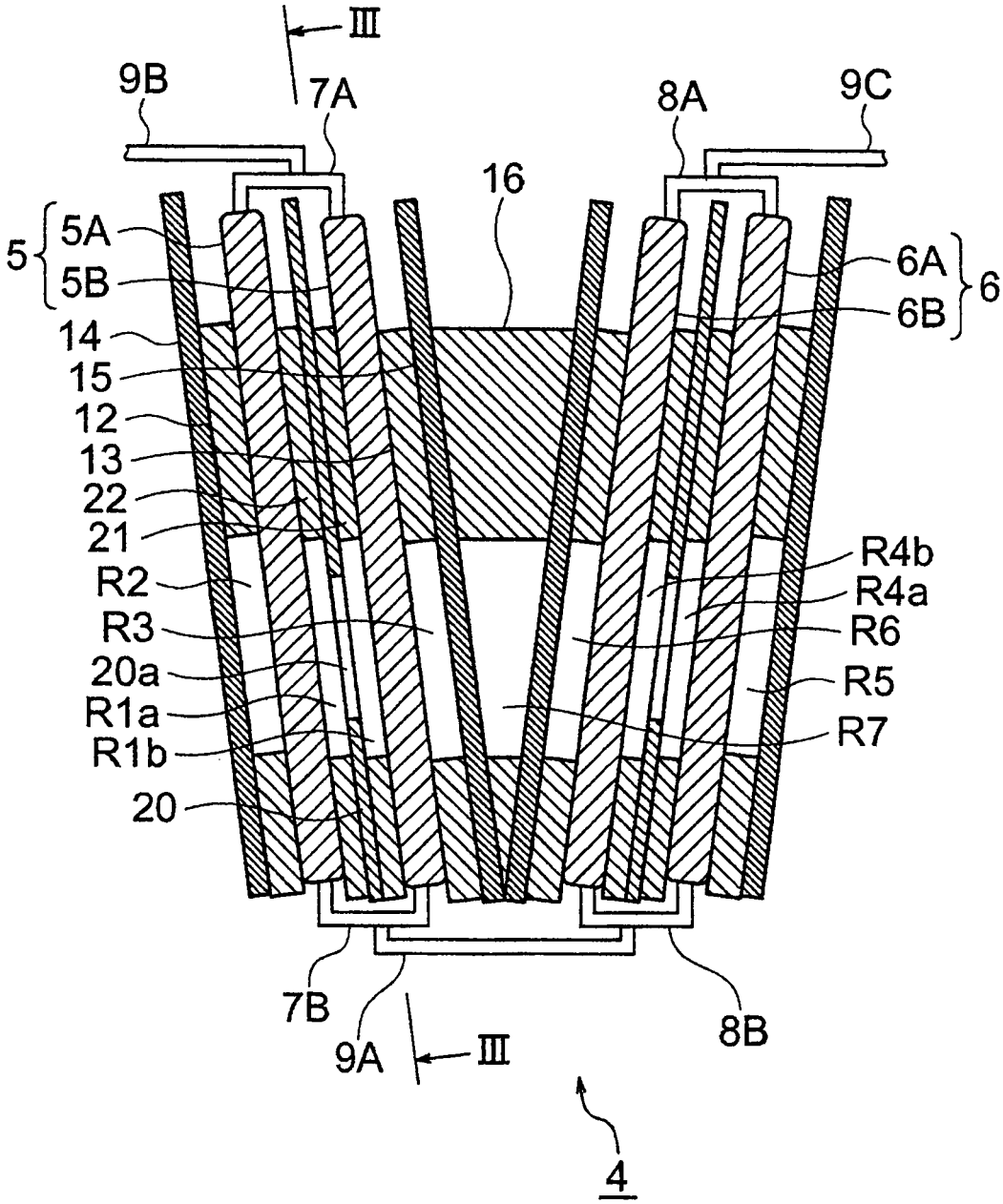
FIG. 4 is a cross-sectional view illustrating a main part of a shell type transformer according to a second embodiment of the present invention.

FIG. 4 is a cross-sectional view illustrating a main part of the shell type transformer 1 according to the second embodiment of the present invention in an enlarged manner. Note that, FIG. 4 corresponds to FIG. 2 of the first embodiment. In addition, the cross section taken along line III-III of FIG. 4 corresponds to the cross section of FIG. 3 of the first embodiment. In FIG. 4, between the partial coils 5A and 5B of the second embodiment, there is disposed an inter-partial-coil insulating plate 20 instead of the inter-partial-coil insulating plate 10 of the first embodiment. The plurality of inter-partial-coil spacer insulators 21 are attached to one surface (first surface) of the inter-partial-coil insulating plate 20 with spaces. In addition, the plurality of inter-partial-coil spacer insulators 22 are attached to the other surface (second surface) of the inter-partial-coil insulating plate 20 with spaces.

The inter-partial-coil spacer insulators 21 and 22 are disposed to overlap with each other (symmetrically) across the inter-partial-coil insulating plate 20 in the direction in which the partial coils 5A and 5B are opposed to each other. Between the partial coils 5A and 5B, refrigerant flow paths R1*a* and R1*b* are formed by the inter-partial-coil insulating plate 20 and the inter-partial-coil spacer insulators 21 and 22, instead of the refrigerant flow path R1 of the first embodiment.

At a portion of the inter-partial-coil insulating plate 20 adjacent to the refrigerant flow paths R1*a* and R1*b*, there is formed an opening 20*a* to communicate to each of the refrigerant flowpaths R1*a* and R1*b*. Note that, on the second partial coil assembly 6 side too, refrigerant flow paths R4*a* and R4*b* are formed instead of the refrigerant flow path R4 of the first embodiment, in the same manner. The other structure is the same as that of the first embodiment.

According to the above-mentioned shell type transformer 1 of the second embodiment, the refrigerant flow paths R1*a* and R1*b* are formed between the partial coils 5A and 5B by the inter-partial-coil insulating plate 20 and the inter-partial-coil spacer insulators 21 and 22. Thus, because the area of the partial coils 5A and 5B contacting with cooling oil becomes larger than that in the structure of the first embodiment, cooling efficiency can be improved.

In addition, the inter-partial-coil spacer insulators 21 and 22 are disposed to overlap with each other across the inter-partial-coil insulating plate 20 in the direction in which the partial coils 5A and 5B are opposed to each other. With this structure, when a short-circuit electromagnetic force is applied to the partial coil 5A, a mechanical power due to the short-circuit electromagnetic force is linearly transmitted to the inter-partial-coil spacer insulators 21 and 22. Therefore, occurrence of deformation and displacement of the partial coils 5A and 5B can be suppressed more strongly, and deformation of the inter-partial-coil insulating plate 20 can also be suppressed.

Further, because the cooling oil can flow from one side to the other of two refrigerant flow paths R1*a* and R1*b* between the partial coils 5A and 5B through the opening 20*a* of the inter-partial-coil insulating plate 20, temperature of the cooling oil in the refrigerant flow paths R1*a* and R1*b* can be uniformed so that cooling efficiency can be improved more.

Note that, the opening 20*a* is formed in the inter-partial-coil insulating plate 20 in the second embodiment, but the opening 20*a* may be eliminated.

In addition, the inter-partial-coil spacer insulators 21 and 22 are disposed to overlap with each other across the inter-partial-coil insulating plate 20 in the direction in which the partial coils 5A and 5B are opposed to each other in the second embodiment. However, it is possible to dispose the inter-partial-coil spacer insulators 21 and 22 at positions shifted from each other in the direction in which the partial coils 5A and 5B are opposed to each other.

Third Embodiment

Figure 5:
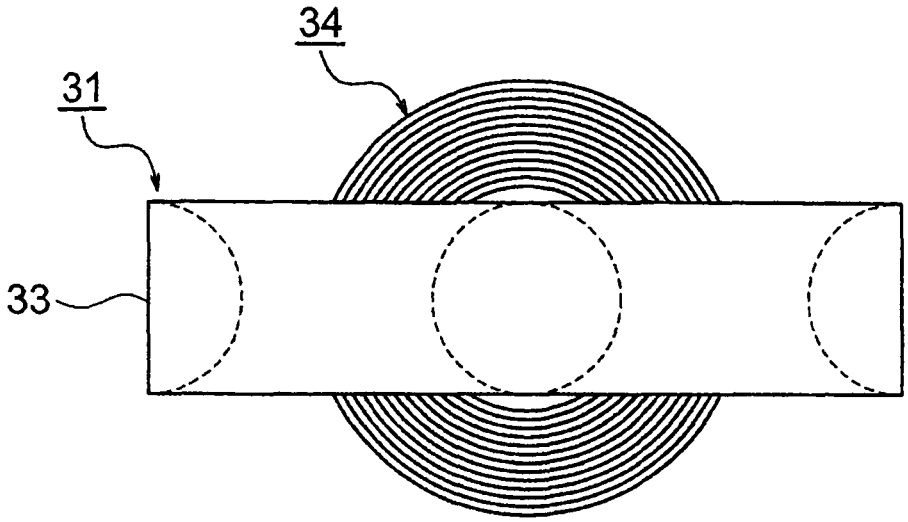
FIG. 5 is a plan view illustrating a core type transformer according to a third embodiment of the present invention.
Figure 6:
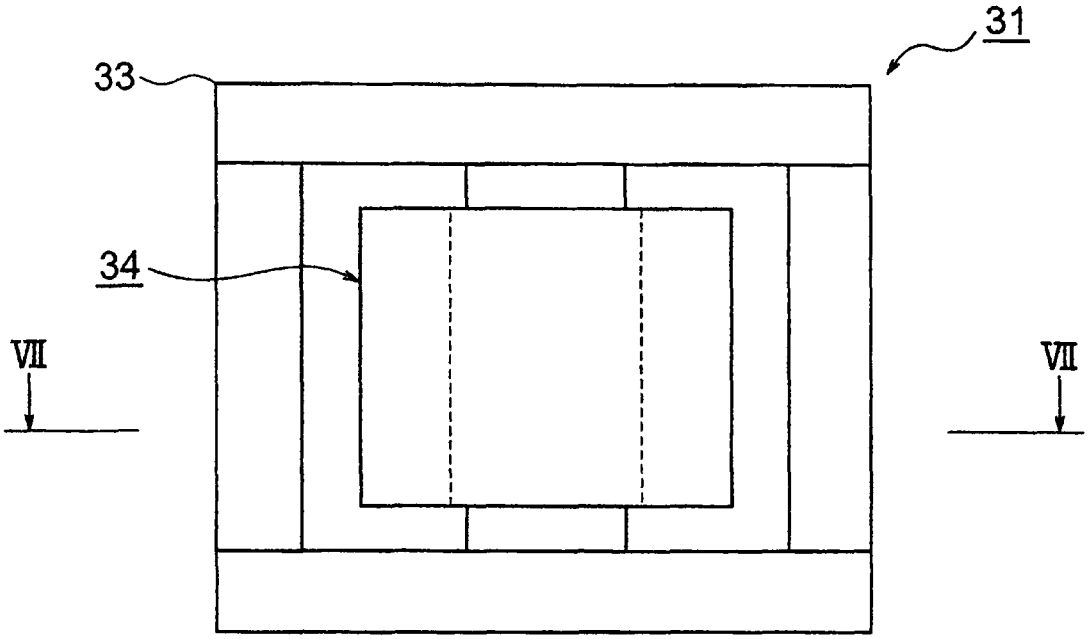
FIG. 6 is a side view illustrating a core type transformer of FIG. 5.
Figure 7:
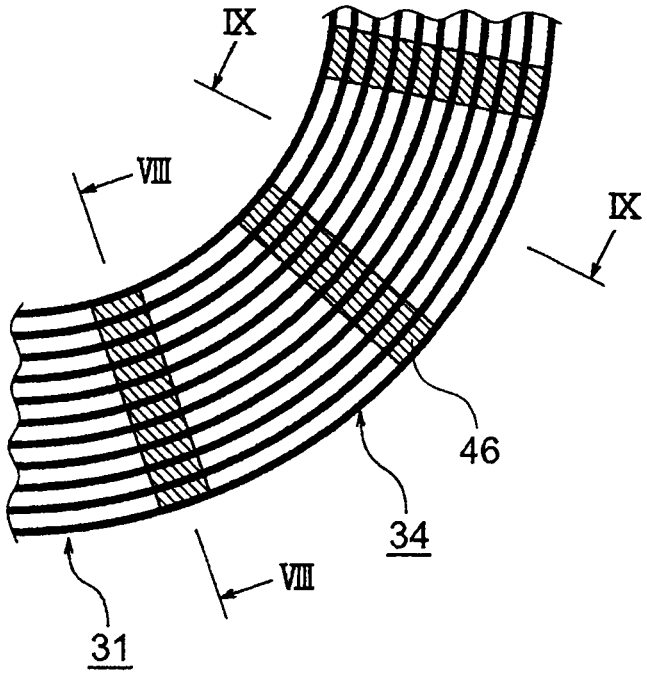
FIG. 7 is a cross-sectional view taken along line VII-VII of FIG. 6.

In the first and second embodiments, the shell type transformer 1 is described as the stationary induction apparatus. In contrast to this, in a third embodiment, a core type transformer 31 is described as the stationary induction apparatus. FIG. 5 is a plan view illustrating the core type transformer 31 according to the third embodiment of the present invention. FIG. 6 is a side view illustrating the core type transformer 31 of FIG. 5. FIG. 7 is a cross-sectional view taken along line VII-VII of FIG. 6.

In FIGS. 5 to 7, the core type transformer 31 as the stationary induction apparatus of the third embodiment includes a tank (not shown), a core 33, and a cylindrical coil body 34. The coil body 34 is attached to the core 33 so as to surround the leg portion of the core 33. The coil body 34 includes a plurality of partial coil assemblies disposed to overlap with each other in a layered manner. Between the partial coil assemblies (partial coil assemblies 35 and 36 of FIG. 8) of the layers of the coil body 34, there are disposed a plurality of inter-coil-assembly insulators 46 as illustrated in FIG. 7. The plurality of inter-coil-assembly insulators 46 are disposed with spaces on each layer of the coil body 34 in the circumferential direction of the coil body 34.

Figure 8:
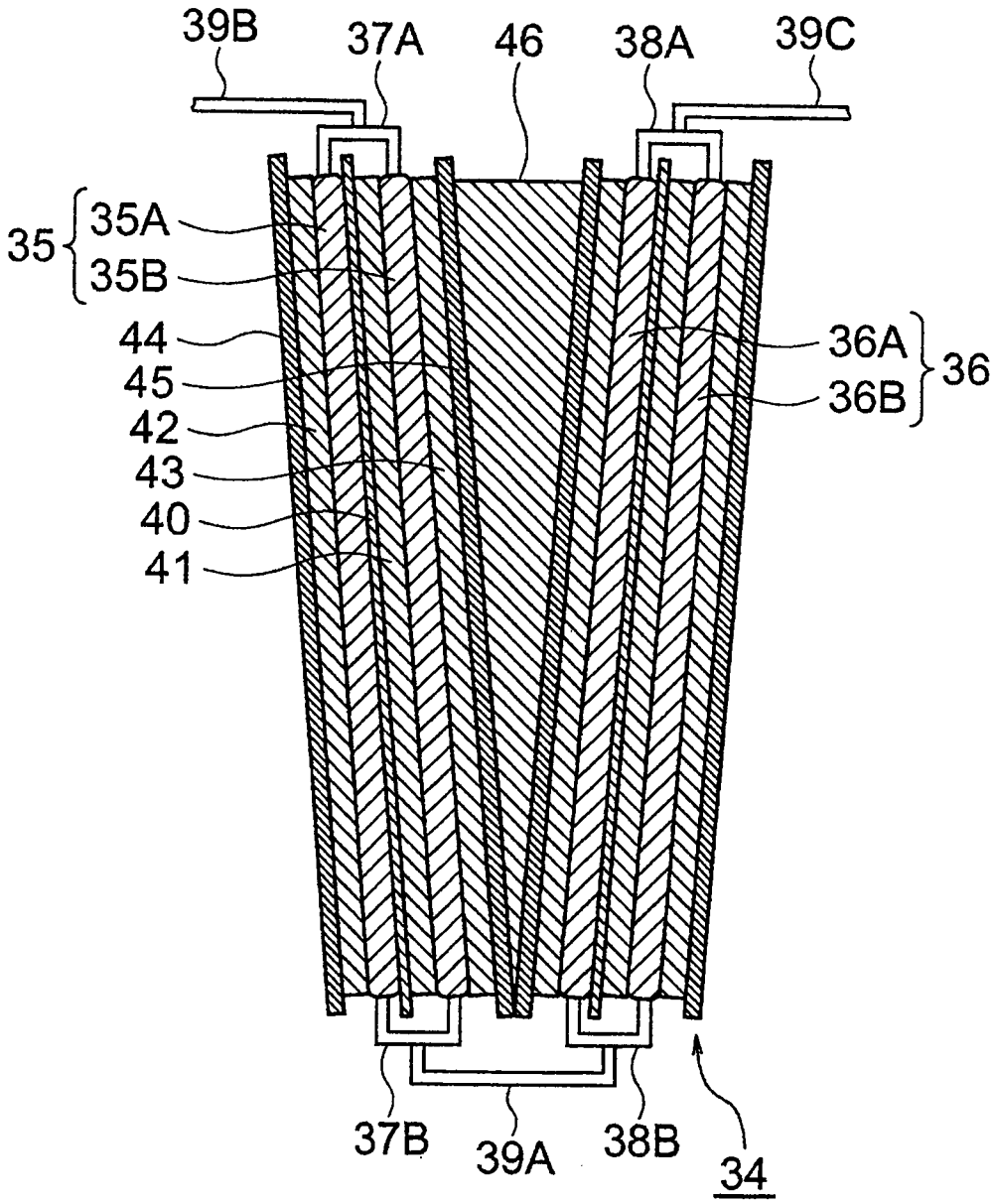
FIG. 8 is a cross-sectional view taken along line VIII-VIII of FIG. 7.
Figure 9:
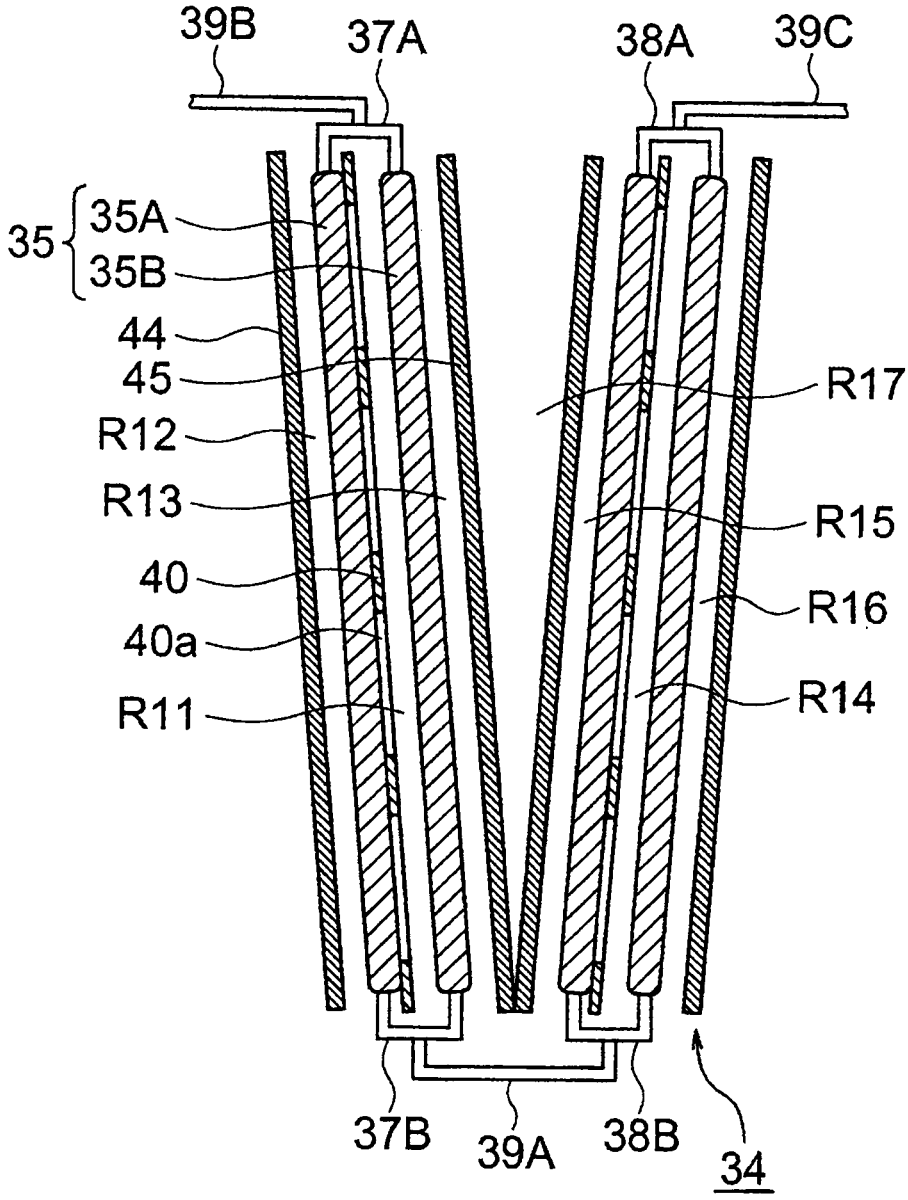
FIG. 9 is a cross-sectional view taken along line IX-IX of FIG. 7.
Figure 10:
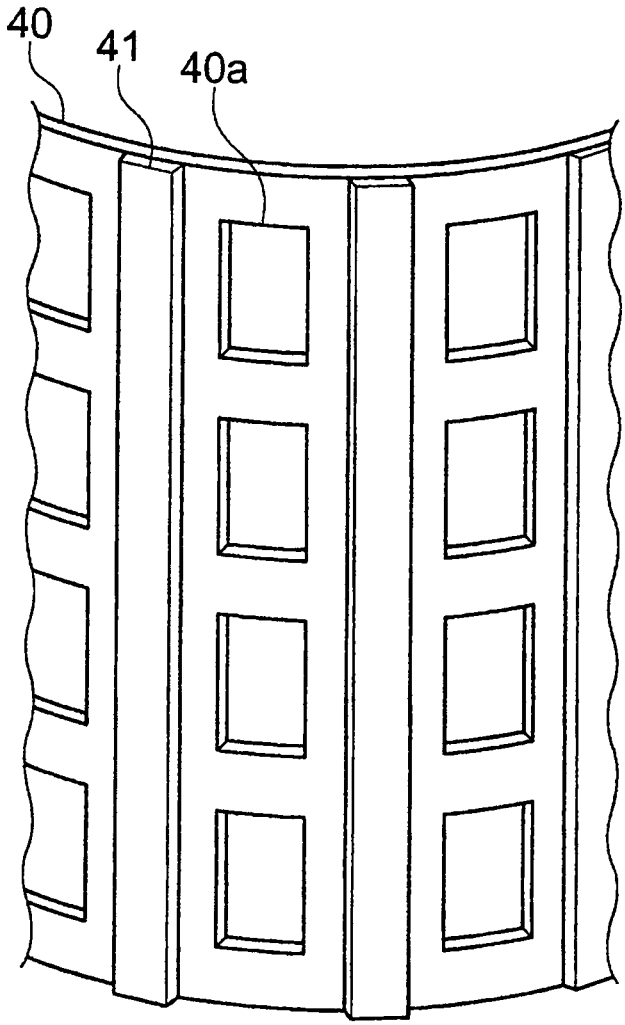
FIG. 10 is a perspective view illustrating an inter-partial-coil insulating plate of FIGS. 8 and 9.

FIG. 8 is a cross-sectional view taken along line VIII-VIII of FIG. 7. FIG. 9 is a cross-sectional view taken along line IX-IX of FIG. 7. FIG. 10 is a perspective view illustrating an inter-partial-coil insulating plate 40 of FIGS. 8 and 9. In FIGS. 8 to 10, a first partial coil assembly 35 is constituted of a set of partial coils 35A and 35B. A second partial coil assembly 36 is constituted of a set of partial coils 36A and 36B.

The upper ends and the lower ends of the partial coils 35A and 35B in the coil body 4 are short-circuited via partial coil connection wires 37A and 37B, respectively. In other words, the partial coils 35A and 35B are connected in parallel via the partial coil connection wires 37A and 37B. Similarly to this, the partial coils 36A and 36B are connected in parallel via partial coil connection wires 38A and 38B.

The lower end side of the first partial coil assembly 35 in the coil body 34 and the lower end side of the second partial coil assembly 36 in the coil body 34 are connected in series via a coil connection wire 39A. In addition, an inter-coil insulation dimension is set at the upper end side of the first partial coil assembly 35 in the coil body 34 and the upper end side of the second partial coil assembly 36 in the coil body 34 so as to withstand a high voltage generated when a high frequency high voltage such as an impulse voltage is applied to the core type transformer 31.

The first partial coil assembly 35 and a coil assembly (not shown) disposed adjacent to the first partial coil assembly 35 on the opposite side (left side of FIGS. 8 and 9) to the second partial coil assembly 36 are connected in series via a coil connection wire 39B at the upper end side of the coil body 34. Similarly to this, the second partial coil assembly 36 and a coil (not shown) disposed adjacent to the second partial coil assembly 36 on the opposite side (right side of FIG. 2) to the first partial coil assembly 35 are connected in series via a coil connection wire 39C at the upper end side of the coil body 34.

Therefore, the partial coils 35A, 35B, 36A, and 36B are connected in parallel to constitute the coil assemblies 35 and 36, which are connected in series to constitute the coil body 34 of the stationary induction apparatus. In other words, the coil body 34 is constituted of the plurality of partial coils 35A, 35B, 36A, 36B, and the like that are disposed to be opposed and overlapped with each other in the radial direction.

Between the adjacent partial coils 35A and 35B, there is disposed the cylindrical inter-partial-coil insulating plate 40 as the inter-partial-coil supporting portion. The inter-partial-coil insulating plate 40 is disposed to cover the entire overlapping region between the partial coils 35A and 35B. In addition, the inner circumference surface (surface on the left side of FIGS. 8 and 9) of the inter-partial-coil insulating plate 40 is disposed in a state of contacting with the outer periphery surface (surface on the right side of FIGS. 8 and 9).

On the outer periphery surface (surface on the right side of FIGS. 8 and 9) of the inter-partial-coil insulating plate 40, a plurality of inter-partial-coil spacer insulators 41 as the inter-partial-coil protrusions are attached with spaces in the circumferential direction of the coil body 34 by adhesive or the like, for example. The plurality of inter-partial-coil spacer insulators 41 are disposed along the axial direction of the coil body 34. In addition, the plurality of inter-partial-coil spacer insulators 41 are disposed between the inter-partial-coil insulating plate 40 and the partial coil 35B.

The space between the adjacent inter-partial-coil spacer insulators 41 in the region between the inter-partial-coil insulating plate 40 and the partial coil 35B is a refrigerant flow path R11. In other words, the inter-partial-coil insulating plate 40 and the plurality of inter-partial-coil spacer insulators 41 form the refrigerant flow path R11 together.

An opening 40*a* is formed in the inter-partial-coil insulating plate 40 between the adjacent inter-partial-coil spacer insulators 41. The opening 40*a* communicates to the refrigerant flow path R11. Thus, a portion of the partial coil 35A adjacent to the opening 40*a* is exposed to the refrigerant flow path R11. In other words, the refrigerant flowing in the refrigerant flow path R11 is guided to the partial coil 35A by the opening 10*a*.

On the inner circumference surface of the first partial coil assembly 35, namely the inner circumference surface (surface on the left side of FIGS. 8 and 9) of the partial coil 35A, there is disposed a cylindrical first outer insulating plate 44 to be opposed to the partial coil 35A with a space therebetween. On the outer periphery surface (surface on the right side of FIGS. 8 and 9) of the first outer insulating plate 44, a plurality of first outer spacer insulators 42 are attached with spaces in the circumferential direction of the coil body 34 by adhesive or the like, for example.

The plurality of first outer spacer insulators 42 are disposed along the axial direction of the coil body 34. In addition, the plurality of first outer spacer insulators 42 are disposed between the first outer insulating plate 44 and the partial coil 35A. A space between the adjacent first outer spacer insulators 42 in the region between the first outer insulating plate 44 and the partial coil 35A is a refrigerant flow path R12. In other words, the first outer insulating plate 44 and the plurality of first outer spacer insulators 42 form the refrigerant flow path R12 together.

On the outer periphery surface of the first partial coil assembly 35, namely on the outer periphery surface (surface on the right side of FIGS. 8 and 9) of the partial coil 35B, there is disposed a second outer insulating plate 45 to be opposed to the partial coil 35B with a space therebetween. On the inner circumference surface (surface on the left side of FIGS. 8 and 9) of the second outer insulating plate 45, there are disposed a plurality of second outer spacer insulators 43 with spaces.

The plurality of third outer spacer insulators 43 are disposed along the axial direction of the coil body 34. In addition, the plurality of second outer spacer insulators 43 is disposed between the second outer insulating plate 45 and the partial coil 35B. A space between the adjacent second outer spacer insulators 43 in a region between the second outer insulating plate 45 and the partial coil 35B is a refrigerant flow path R13. In other words, the second outer insulating plate 45 and the plurality of second outer spacer insulators 43 form the refrigerant flow path R13 together.

As to the second partial coil assembly 36 too, similarly to the first partial coil assembly 35, there are disposed insulating plates equivalent to the inter-partial-coil insulating plate 40 and the first and second outer insulating plates 44 and 45, and insulators equivalent to the inter-partial-coil spacer insulator 41 and the first and second outer spacer insulators 42 and 43. A plurality of refrigerant flow paths R14 to R16 are formed in the second partial coil assembly 36 by the insulating plates and the insulators.

Between the first partial coil assembly 35 and the second partial coil assembly 36 (between the outer insulating plates), there are disposed a plurality of inter-coil-assembly insulators 46 with spaces in the circumferential direction of the coil body 34. The plurality of inter-coil-assembly insulators 46 form a refrigerant flow path R17 together between the first partial coil assembly 35 and the second partial coil assembly 36. The other structure is the same as that of the first embodiment.

Here, between the partial coils 35A and 35B, and between the partial coils 36A and 36B, there are formed inter-partial-coil insulation dimensions respectively for withstanding an abnormal voltage. In order to secure the inter-partial-coil insulation dimensions, the inter-partial-coil insulating plate 40 and the plurality of inter-partial-coil spacer insulators 41 support both the partial coils 35A and 35B.

In addition, the insulators 41, 42, 43, and 46 are disposed to overlap with each other in the direction in which the partial coils 35A and 35B are opposed to each other. In other words, the insulators 41, 42, 43, and 46 are disposed to be the same position in the radial direction of the coil body 4.

According to the above-mentioned core type transformer 31 of the third embodiment, the inter-partial-coil insulating plate 40 and the plurality of inter-partial-coil spacer insulators 41 are disposed between the partial coils 35A and 35B so as to cover the entire overlapping region between the partial coils 35A and 35B. The inter-partial-coil insulating plate 40 and the plurality of inter-partial-coil spacer insulators 41 support the partial coils 35A and 35B so as to maintain the space between the partial coils 35A and 35B and form the refrigerant flow path R11 between the partial coils 35A and 35B. With this structure, also in the core type transformer 31, it is possible to obtain the same effect as in the shell type transformer 1 of the first embodiment.

Note that, the plurality of inter-partial-coil spacer insulators 41 are disposed on only one side of the inter-partial-coil insulating plate 40 in the third embodiment. However, it is possible to dispose the inter-partial-coil spacer insulator on both sides of the inter-partial-coil insulating plate 40 like the inter-partial-coil insulating plate 20 of the second embodiment. In this case, it is possible to enlarge the area capable of contacting with the cooling oil for the partial coil. Because the cooling oil can flow in two oil flow paths between the partial coils via the opening in the inter-partial-coil insulating plate, cooling efficiency of the partial coil can be improved.

Fourth Embodiment

The first to third embodiments describe the structure of improving cooling performance by cooling the partial coil from both sides so that temperature rise of the stationary induction apparatus is reduced. Here, in each partial coil, because amplitude of magnetic flux making linkage with each winding is different among windings, the induced electromotive force to be generated is different. Therefore, as illustrated in FIG. 2, for example, when the partial coils are short-circuited at both ends, respectively, a large cyclic current flows in the cylindrical winding so that a loss of the stationary induction apparatus increases. As a result, it may be difficult to suppress a temperature rise of the stationary induction apparatus.

Therefore, in a fourth embodiment and thereafter, there is described a structure to solve the above-mentioned problem, namely a structure capable of securing cooling performance of the coil while reducing cyclic current flowing in the coil so as to prevent increase of loss.

Figure 11:
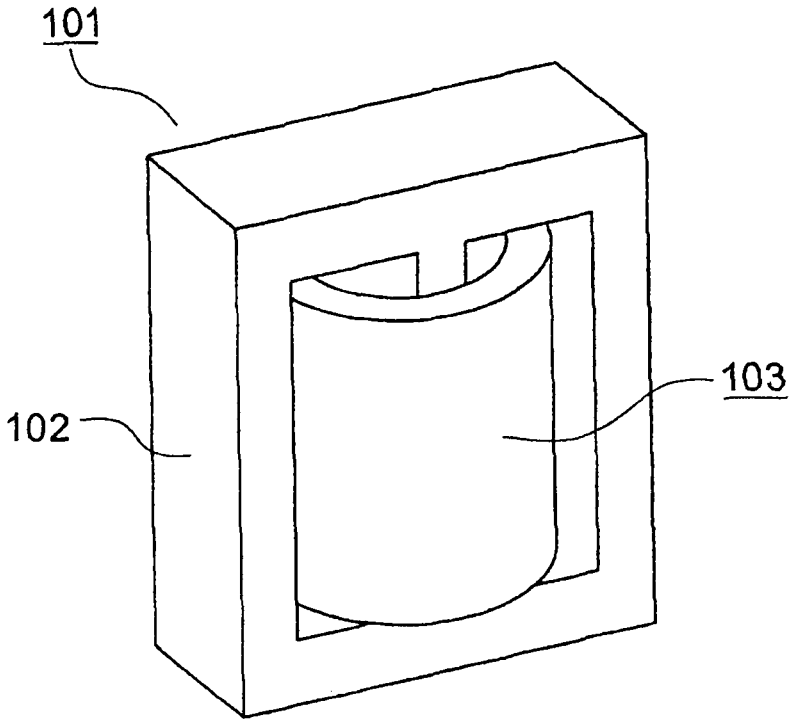
FIG. 11 is a perspective view illustrating a core type transformer according to a fourth embodiment of the present invention.
Figure 12:
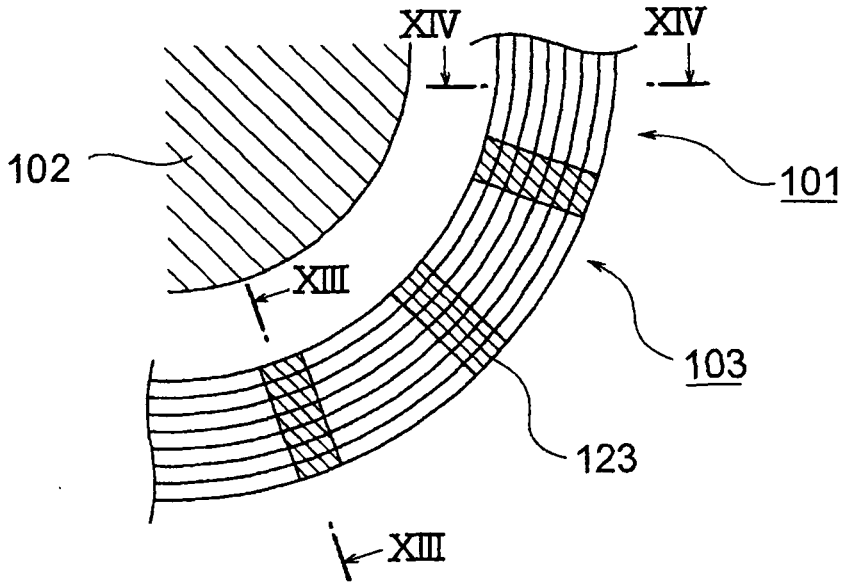
FIG. 12 is a cross-sectional view illustrating parts of a core and a coil body of FIG. 11 in an enlarged manner.
Figure 13:
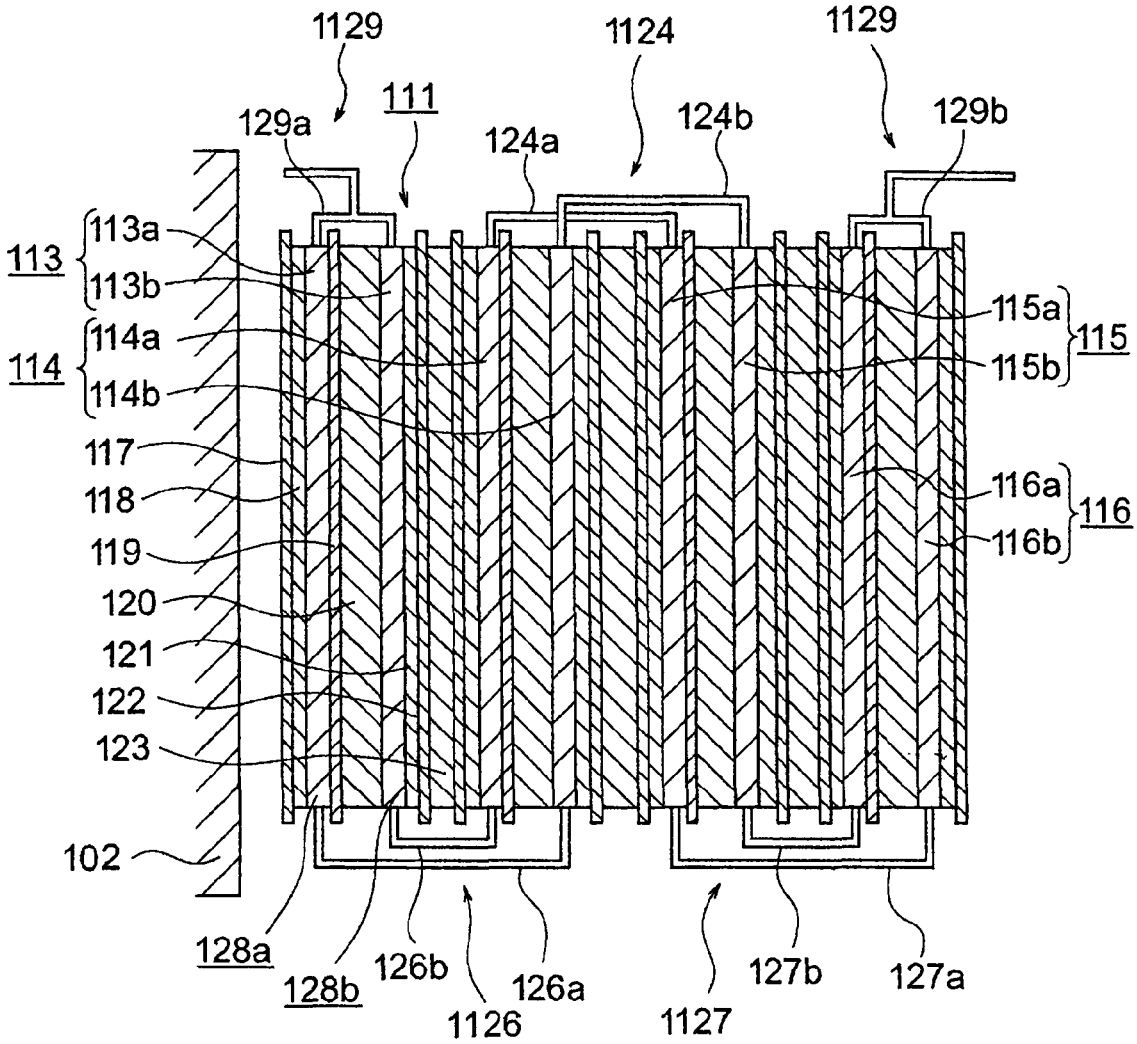
FIG. 13 is a cross-sectional view taken along line XIII-XIII of FIG. 12.
Figure 14:
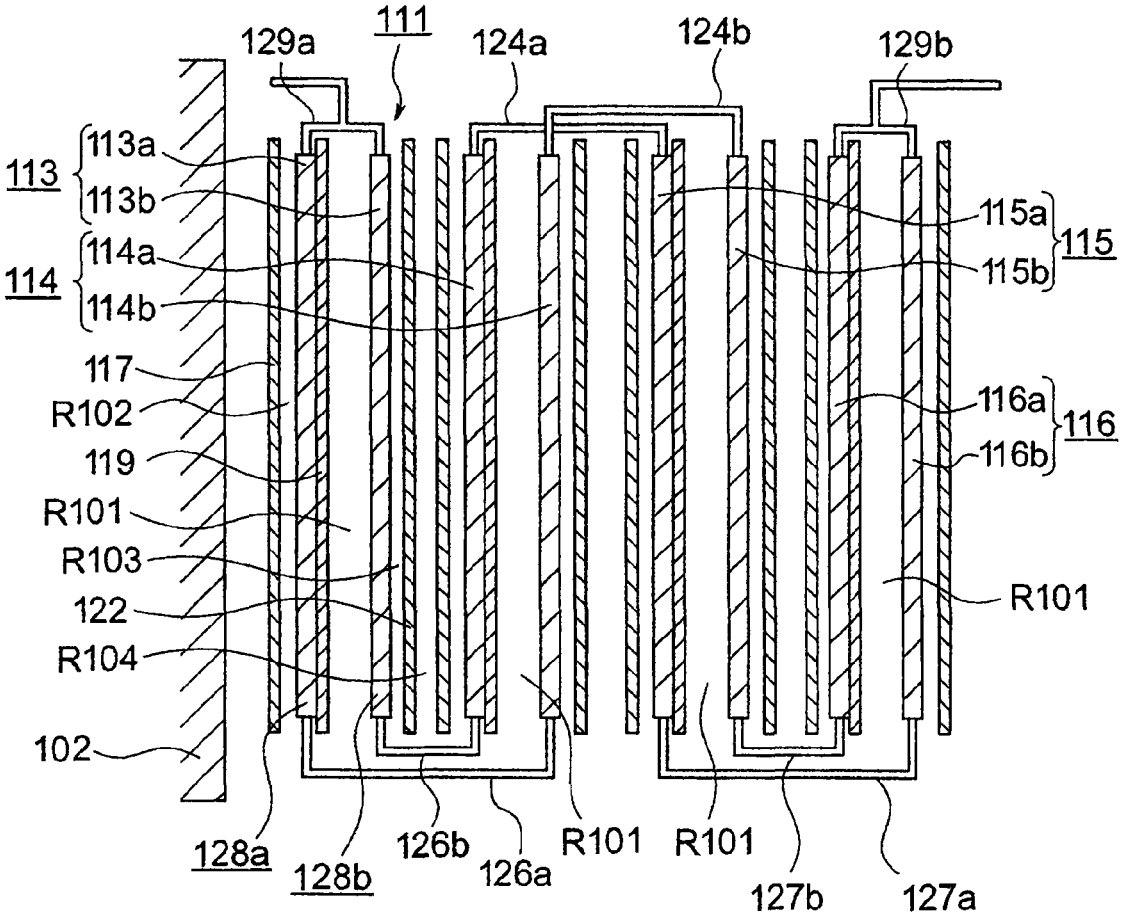
FIG. 14 is a cross-sectional view taken along line XIV-XIV of FIG. 12.

FIG. 11 is a perspective view illustrating a core type transformer according to the fourth embodiment of the present invention. FIG. 12 is a cross-sectional view illustrating parts of the core and the coil body of FIG. 11 in an enlarged manner. FIG. 13 is a cross-sectional view taken along line XIII-XIII of FIG. 12. FIG. 14 is a cross-sectional view taken along line XIV-XIV of FIG. 12.

In FIGS. 11 and 12, a core type transformer 101 as the stationary induction apparatus of the fourth embodiment includes a tank (not shown), a core 102, and a cylindrical coil body 103. The coil body 103 is attached to the core 102 so as to surround a leg portion of the core 102. The coil body 103 includes three or more partial coil assemblies arranged to overlap each other in a layered manner in the radial direction.

The partial coil assembly of the fourth embodiment includes four partial coil assemblies 113, 114, 115, and 116.

The four partial coil assemblies 113, 114, 115, and 116 are disposed so as to be adjacent sequentially. In order from the spool (core), the first partial coil assembly 113, the second partial coil assembly 114, the third partial coil assembly 115, and the fourth partial coil assembly 116 are arranged. Note that, "adjacent" means, for example, a relationship between the first and the second, or a relationship between the (n−1)th and the n-th from the spool, and does not include a relationship between the first and the third, for example.

Between the first partial coil assembly 113 and the second partial coil assembly 114, there is disposed a plurality of inter-coil-assembly insulators 123 as illustrated in FIG. 12. The plurality of inter-coil-assembly insulators 123 are disposed with spaces in the circumferential direction of the coil body 103. Note that, a coil body 111 of FIG. 13 corresponds to the coil body 103 of FIG. 12.

In FIGS. 13 and 14, the first partial coil assembly 113 is constituted of a set of inner partial coil 113*a* and outer partial coil 113*b*. Note that, as to "inner" and "outer", among the partial coils constituting the partial coil assembly, the side relatively closer to the spool or the core 102, namely the inner side in the radial direction is regarded as the "inner".

Similarly, the second partial coil assembly 114 is constituted of a set of inner partial coil 114*a* and outer partial coil 114*b*. The third partial coil assembly 115 is constituted of a set of inner partial coil 115*a* and outer partial coil 115*b*. The fourth partial coil assembly 116 is constituted of a set of inner partial coil 116*a* and outer partial coil 116*b*.

Between the adjacent partial coils 113*a* and 113*b*, there is disposed a cylindrical inter-partial-coil insulating plate 119. The inter-partial-coil insulating plate 119 is disposed to cover the entire overlapping region between the partial coils 113*a* and 113*b*. In addition, the inner circumference surface of the inter-partial-coil insulating plate 119 (surface on the left side of FIGS. 13 and 14) is disposed in a state of contacting with the outer periphery surface of the partial coil 113*a*.

On the outer periphery surface of the inter-partial-coil insulating plate 119 (surface on the right side of FIGS. 13 and 14), a plurality of inter-partial-coil spacer insulators 120 as the inter-partial-coil protrusions are attached with spaces in the circumferential direction of the coil body 111. In addition, a plurality of inter-partial-coil spacer insulators 120 are disposed between the inter-partial-coil insulating plate 119 and the partial coil 113*b*.

A partial coil surface oil flow path (refrigerant flow path) R101 is formed between the inter-partial-coil spacer insulators 120, 120 that are adjacent in the circumferential direction in the region between the inter-partial-coil insulating plate 119 and the partial coil 113*b*. In other words, the inter-partial-coil insulating plate 119 and the plurality of inter-partial-coil spacer insulators 120 form the partial coil surface oil flow path R101 together.

Concerning at least one partial coil assembly, the partial coil surface oil flow path (refrigerant flow path) R101 is disposed between at least one pair of partial coils belonging to the partial coil assembly, and hence the refrigerant can flow between the partial coils. In this example, the partial coil surface oil flow path (refrigerant flow path) R101 is disposed in each of the four partial coil assemblies. Specifically, the partial coil surface oil flow path R101 is formed in each of between the partial coils 113*a* and 113*b*, between the partial coils 114*a* and 114*b*, between the partial coils 115*a* and 115*b*, and between the partial coils 116*a* and 116*b*.

On an inner surface of the first partial coil assembly 113, namely on an surface of the inner partial coil 113*a* on the opposite side to the inter-partial-coil insulating plate 119, a cylindrical first inter-coil insulating plate 117 is disposed with a space from the inner partial coil 113*a*.

A plurality of first inter-coil spacer insulators 118 are disposed along the axial direction of the coil body 111. In addition, the plurality of first inter-coil spacer insulators 118 are disposed between the first inter-coil insulating plate 117 and the inner partial coil 113*a*. Between the first inter-coil spacer insulators 118, 118 that are adjacent in the region between the first inter-coil insulating plate 117 and the inner partial coil 113*a*, there is formed a coil surface oil flow path R102.

On the outer surface of the first partial coil assembly 113, namely on the outer periphery surface of the outer partial coil 113*b* (surface on the right side of FIGS. 13 and 14), there is disposed a cylindrical second inter-coil insulating plate 122 with a space from the outer partial coil 113*b*.

A plurality of second inter-coil spacer insulators 121 are disposed along the axial direction of the coil body 111. In addition, the plurality of second inter-coil spacer insulators 121 are disposed between the second inter-coil insulating plate 122 and the outer partial coil 113*b*. Between the space between the second inter-coil spacer insulators 121, 121 that are adjacent in the region between the second inter-coil insulating plate 122 and the partial coil 113*b*, there is formed a coil surface oil flow path R103.

Between the first partial coil assembly 113 and the second partial coil assembly 114, there are disposed the plurality of inter-coil-assembly insulators 123 with a space in the circumferential direction of the coil body 111. Between the inter-coil-assembly insulators 123 and 123 adjacent in the circumferential direction, an inter-coil-assembly oil flow path R104 is formed so as to be sandwiched between the first partial coil assembly 113 and the second partial coil assembly 114.

The partial coils 113*a* and 113*b* belonging to the first partial coil assembly 113 are short-circuited at the upper end side of the coil body 111 by a partial coil connection wire 129*a* of the upper end side constituting a simple connection portion 1129. Similarly, the partial coils 116*a* and 116*b* belonging to the fourth partial coil assembly 116 are short-circuited at the upper end side of the coil body 111 by a partial coil connection wire 129*b* of the upper end side constituting the simple connection portion 1129.

The partial coils 114*a* and 114*b* belonging to the second partial coil assembly 114 and the partial coils 115*a* and 115*b* belonging to the third partial coil assembly 115 are connected at the upper end side of the coil body 111 by a spool reference connection portion 1124. The spool reference connection portion 1124 includes coil connection wires of the number corresponding to the number of partial coil columns described later, which are constituted of partial coil connection wires 124*a* and 124*b* of the upper end side in this embodiment.

The spool reference connection portion 1124 connects the plurality of partial coils belonging to one of adjacent partial coil assemblies to the plurality of partial coils belonging to the other partial coil assembly one to one in order from the pair closest to the spool. Therefore, in this embodiment, the inner partial coil 114*a* closer to the spool (inner in the radial direction) out of the partial coils 114*a* and 114*b* and the inner partial coil 115*a* closer to the spool out of the partial coils 115*a* and 115*b* are connected via the partial coil connection wire 124*a* of the upper end side, and then the outer partial coil 114*b* and the outer partial coil 115*b*, which are next closest to the spool, are connected via the partial coil connection wire 124*b* of the upper end side.

This structure can be regarded differently as a structure in which the outer partial coil 114*b* close to the third partial coil assembly 115 out of the partial coils 114*a* and 114*b*, and the outer partial coil 115*b* distant from the second partial coil assembly 114 out of the partial coils 115*a* and 115*b* are connected. Similarly, it can also be regarded that the inner partial coil 114*a* distant from the third partial coil assembly 115 out of the partial coils 114*a* and 114*b*, and the inner partial coil 115*a* close to the second partial coil assembly 114 out of the partial coils 115*a* and 115*b* are connected.

The partial coils 113*a* and 113*b* belonging to the first partial coil assembly 113 and the partial coils 114*a* and 114*b* belonging to the second partial coil assembly 114 are connected at the lower end side of the coil body 111 via an adjacent reference connection portion 1126. Similarly, the partial coils 115*a* and 115*b* belonging to the third partial coil assembly 115 and the partial coils 116*a* and 116*b* belonging to the fourth partial coil assembly 116 are connected at the upper end side of the coil body 111 via an adjacent reference connection portion 1127. The adjacent reference connection portions 1126 and 1127 include coil connection wires of the number corresponding to the number of partial coil columns described later, which are constituted of partial coil connection wires 126*a*, 126*b*, 127*a*, and 127*b* of the lower end side in this embodiment.

The adjacent reference connection portions 1126 and 1127 connect the plurality of partial coils belonging to one of adjacent partial coil assemblies to the plurality of partial coils belonging to the other partial coil assembly one to one in order from the pair closer to each other. Therefore, in this embodiment, in the adjacent pair of partial coil assemblies 113 and 114, the partial coil 113*b* and the partial coil 114*a*, which are close to each other, are connected by the partial coil connection wire 126*b* of the lower end side. Then, the partial coil 113*a* and the partial coil 114*b*, which are next closest to each other, are connected via the partial coil connection wire 126*a* of the lower end side.

This structure can be regarded differently as a structure in which the outer partial coil 113*b* close to the second partial coil assembly 114 out of the partial coils 113*a* and 113*b*, and the inner partial coil 114*a* close to the first partial coil assembly 113 out of the partial coils 114*a* and 114*b* are connected. Similarly, it can also be regarded that the inner partial coil 113*a* distant from the second partial coil assembly 114 out of the partial coils 113*a* and 113*b*, and the outer partial coil 114*b* distant from the first partial coil assembly 113 out of the partial coils 114*a* and 114*b* are connected.

The same is true for the adjacent pair of partial coil assemblies 115 and 116. The partial coil 115*b* and the partial coil 116*a*, which are close to each other, are connected via the partial coil connection wire 127*b* of the lower end side, and then the partial coil 115*a* and the partial coil 116*b*, which are next closest to each other, are connected via the partial coil connection wire 127*a* of the lower end side.

This structure can also be regarded differently as a structure in which the outer partial coil 115*b* close to the fourth partial coil assembly 116 out of the partial coils 115*a* and 115*b*, and the inner partial coil 116*a* close to the third partial coil assembly 115 out of the partial coils 116*a* and 116*b* are connected. Similarly, it can be also regarded that the inner partial coil 115*a* distant from the fourth partial coil assembly 116 out of the partial coils 115*a* and 115*b*, and the outer partial coil 116*b* distant from the third partial coil assembly 115 out of the partial coils 116*a* and 116*b* are connected.

When the above-mentioned connection is performed, the partial coils 113*a*, 114*b*, 115*b*, and 116*a* are connected in series to form a partial coil column 128*a*. Similarly, the partial coil 113*b*, 114*a*, 115*a*, 116*b* are connected in series to form a partial coil column 128*b*.

Figure 15:
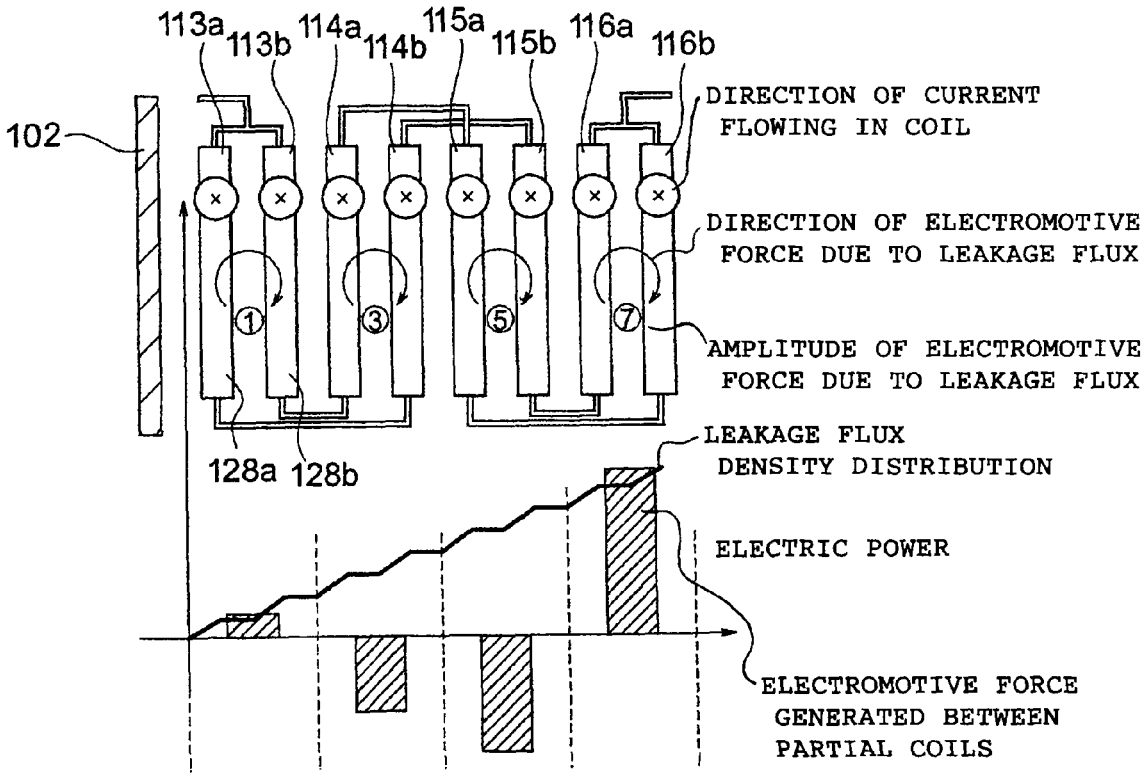
FIG. 15 is a diagram illustrating a relationship among each partial coil assembly, a level of corresponding leakage flux, and induced electromotive force generated in the partial coil assembly.

According to the above-mentioned core type transformer 101 of the fourth embodiment, as illustrated in FIG. 15, induced electromotive forces generated in the individual partial coil assemblies due to leakage flux are canceled by each other so that cyclic current is reduced, and hence increase of loss can be suppressed. The curve denoted by symbol "a" in the lower part of FIG. 15 indicates an intensity distribution of the leakage flux inside the core type transformer 101. In addition, the bar graph denoted by symbol "b" in the lower part of FIG. 15 indicates an induced electromotive force generated in each partial coil assembly by the leakage flux. Further, above the curve and the bar graph in the lower part of FIG. 15, the coils illustrated in FIGS. 13 and 14 are schematically illustrated in a corresponding manner.

The induced electromotive force illustrated by the height in the bar graph b of FIG. 15 indicates a potential of the partial coil belonging to the partial coil column 128*b* with reference to a potential of the partial coil belonging to the partial coil column 128*a* in each partial coil assembly. In the curve and the bar graph illustrated in FIG. 15, the horizontal axis represents a position of each partial coil assembly, and the vertical axis represents a level of leakage flux and the induced electromotive force generated in the partial coil assembly.

In terms of comparison of relative size and direction among the partial inter-coil-assemblies, in the first partial coil assembly 113, there is generated the induced electromotive force having an amplitude of "1" and positive direction as the potential of the outer partial coil 113*b* with reference to the potential of the inner partial coil 113*a*. In the second partial coil assembly 114, there is generated the induced electromotive force having an amplitude of "3" and negative direction as the potential of the inner partial coil 114*a* with reference to the potential of the outer partial coil 114*b*.

In the third partial coil assembly 115, there is generated the induced electromotive force having an amplitude of "5" and negative direction as the potential of the inner partial coil 115*a* with reference to the potential of the outer partial coil 115*b*. In the fourth partial coil assembly 116, there is generated the induced electromotive force having an amplitude of "7" and positive direction as the potential of the outer partial coil 116*b* with reference to the potential of the inner partial coil 116*a*.

Therefore, a total potential difference between the partial coil column 128*a* in which the partial coil 113*a*, 114*b*, 115*b*, and 116*a* are connected in series and the partial coil column 128*b* in which the partial coils 113*b*, 114*a*, 115*a*, 116*b* are connected in series becomes zero. In other words, according to the core type transformer 101 of the fourth embodiment, the induced electromotive forces generated in the individual partial coil assemblies are canceled by each other as a whole so that the cyclic current is reduced.

Note that, the fourth embodiment describes the case where the four partial coil assemblies having the above-mentioned specific connection are included, namely the case where each of the partial coil columns having a specific connection is constituted of the four partial coils. However, this example is not a limitation. In general, if 4n partial coil assemblies are included, namely if the partial coil column is constituted of 4n (n denotes an integer of 1 or larger) partial coils, the above-mentioned cyclic current reducing effect can be obtained by the connection as follows.

First, the partial coils belonging to the first partial coil assembly are short-circuited at the upper end side by the simple connection portion. Similarly, the partial coils belonging to the 4n-th partial coil assembly are short-circuited at the upper end side by the simple connection portion.

Next, the (2+4k)th partial coil assembly (k denotes a positive integer of 1 to n−1 or zero) and the (3+4k)th partial coil assembly are connected on the upper end side by the spool reference connection portion.

The (4+4m)th partial coil assembly (m denotes a positive integer of 1 to n−2 or zero) and the (5+4m)th partial coil assembly are connected at the upper end side by one of the following methods:

(1) connecting by the spool reference connection portion;

(2) connecting by the adjacent reference connection portion; and (3) short-circuiting the partial coils belonging to the (4+4m)th partial coil assembly, short-circuiting the partial coils belonging to the (5+4m)th partial coil assembly, and further connecting the (4+4m)th partial coil assembly and the (5+4m)th partial coil assembly to each other.

As to the lower end side, it is supposed that the partial coils belonging to the (j−1)th partial coil assembly (j denotes an even number of 2 to 4n) and the partial coils belonging to the j-th partial coil assembly are connected by the adjacent reference connection portion.

In addition, also in the case where the partial coil column is constituted of 4n+1 to 4n+3 (n denotes an integer of 1 or larger) partial coils, a potential difference generated between the partial coil columns can be reduced, and the cyclic current can be reduced so as to suppress increase of loss for at least 4n partial coils, by the same connection as the case where the partial coil column is constituted of 4n partial coils.

Note that, even with a structure in which the positional relationship between the upper end and the lower end of the above-mentioned connection is reversed in the fourth embodiment, the same effect as the fourth embodiment can be obtained.

Fifth Embodiment

Figure 16:
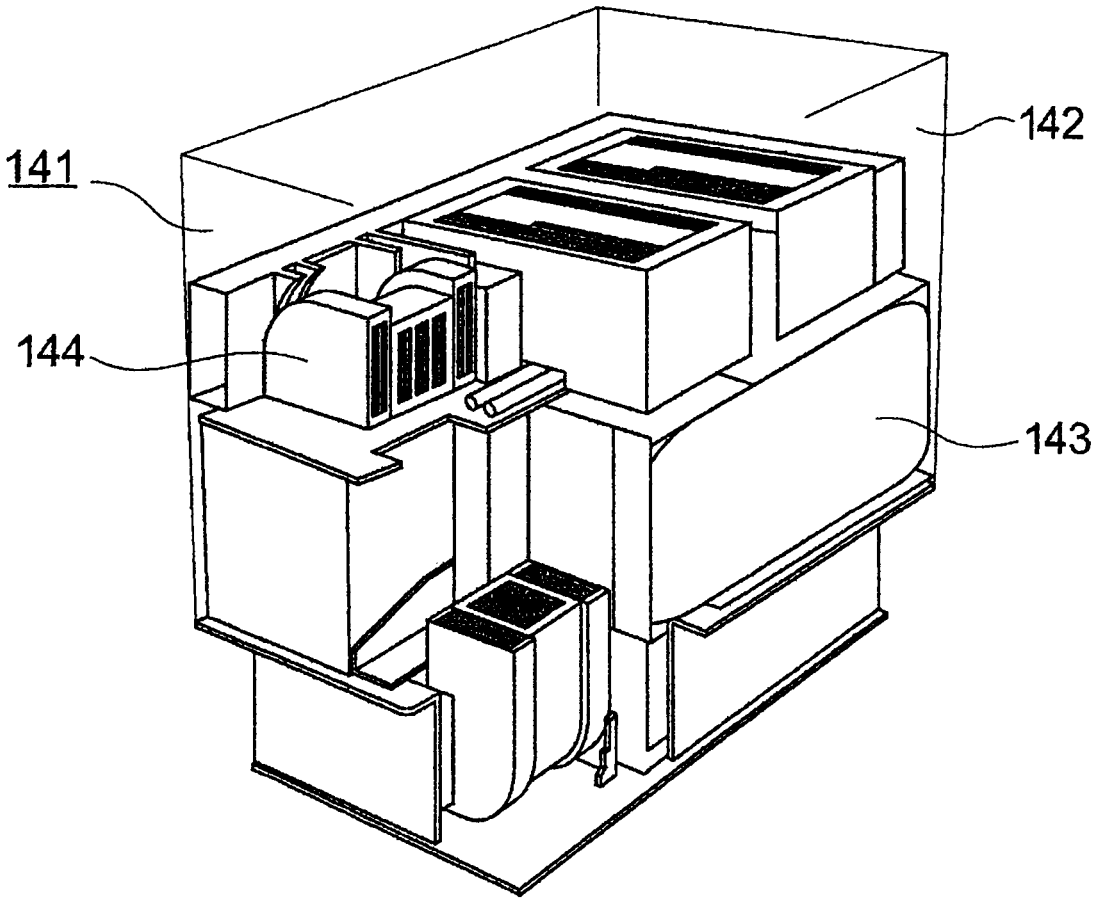
FIG. 16 is a perspective view illustrating a shell type transformer according to a fifth embodiment of the present invention.
Figure 17:
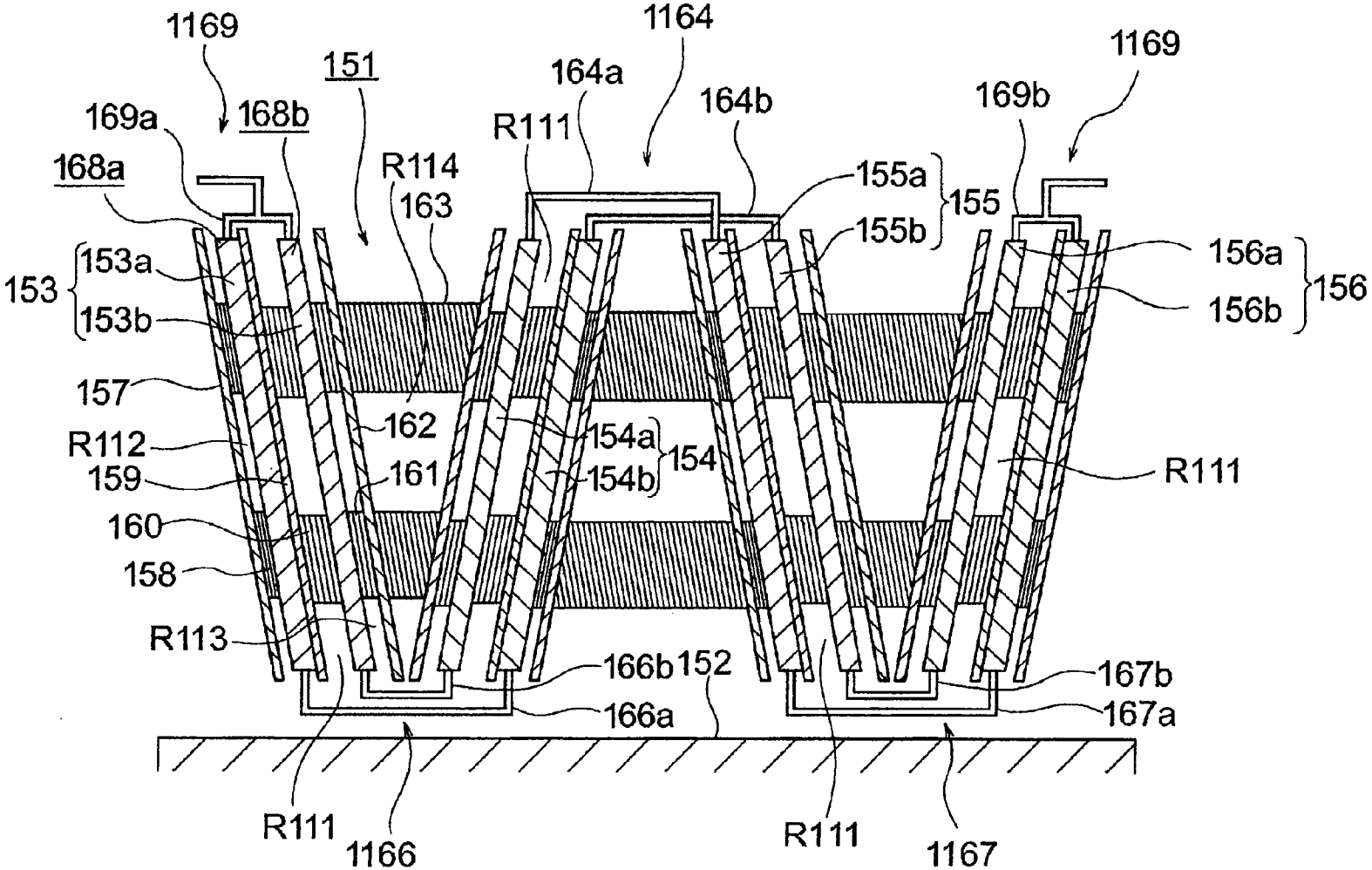
FIG. 17 is a cross-sectional view illustrating a part of a coil body of FIG. 16 in an enlarged manner.

FIG. 16 is a perspective view illustrating a shell type transformer according to a fifth embodiment of the present invention. FIG. 17 is a cross-sectional view illustrating a part of the coil body of FIG. 16 in an enlarged manner. Note that, FIG. 16 illustrates parts of the tank, the core, and the coil body as a cross section. In addition, the upper side of FIG. 17 corresponds to the outer periphery side of the coil body while the lower side of FIG. 17 corresponds to the inner circumference side of the coil body.

In FIGS. 16 and 17, a shell type transformer 141 as the stationary induction apparatus includes a tank 142, a core 143, and a coil body 144. The cooling oil (refrigerant; not shown) is filled in the tank 142. The core 143 and the coil body 144 are housed in the tank 142. The coil body 144 is attached so as to surround a leg portion (center shaft) of the core 143. Note that, a coil body 151 of FIG. 17 corresponds to the coil body 144 illustrated in FIG. 16.

In FIG. 17, the coil body 151 includes a plurality of partial coil assemblies in addition to partial coil assemblies 153, 154, 155, and 156. The first partial coil assembly 153 is constituted of a set of partial coils 153*a* and 153*b*. Similarly, the second partial coil assembly 154 is constituted of a set of partial coils 154*a* and 154*b*. The third partial coil assembly 155 is constituted of a set of partial coils 155*a* and 155*b*. The fourth partial coil assembly 156 is constituted of a set of partial coils 156*a* and 156*b*. Each of the partial coils 153*a*, 153*b*, 154*a*, 154*b*, 155*a*, 155*b*, 156*a*, and 156*b* is formed in a flat plate shape by winding wire in a flat plate shape.

Between the adjacent partial coils 153*a* and 153*b*, there is disposed an inter-partial-coil insulating plate 159 having a flat plate shape as the inter-partial-coil supporting portion. The inter-partial-coil insulating plate 159 is disposed to cover the entire overlapping region between the partial coils 153*a* and 153*b*. In addition, one surface of the inter-partial-coil insulating plate 159 (surface on the left side of FIG. 17) is disposed to contact with a surface of the partial coil 153*a* on the partial coil 153*b* side.

On the other surface of the inter-partial-coil insulating plate 159 (surface on the right side of FIG. 17), a plurality of inter-partial-coil spacer insulators 160 are attached with spaces. The plurality of inter-partial-coil spacer insulators 160 are disposed between the inter-partial-coil insulating plate 159 and the partial coil 153*b*. The space between the adjacent inter-partial-coil spacer insulators in the region between the inter-partial-coil insulating plate 159 and the partial coil 153*b* forms a partial coil surface oil flow path (refrigerant flow path) R111.

The partial coil surface oil flow path (refrigerant flow path) R111 is also disposed between at least one pair of partial coils similarly to the partial coil surface oil flow path R101. In this example, the partial coil surface oil flow path R111 is disposed in each of the four partial coil assemblies.

On one of outer surfaces of the first partial coil assembly 153, namely on a surface of the partial coil 153*a* on the opposite side to the inter-partial-coil insulating plate 159, a first inter-coil insulating plate 157 is disposed to be opposed to the partial coil 153*a* with a space therebetween. On the side surface of the first inter-coil insulating plate 157 on the partial coil 153*a* side, a plurality of first inter-coil spacer insulators 158 are disposed with spaces.

The plurality of first inter-coil spacer insulators 158 are disposed between the first inter-coil insulating plate 157 and the partial coil 153*a*. The space between the adjacent first inter-coil spacer insulators 158 in the region between the first inter-coil insulating plate 157 and the partial coil 153*a* forms a coil surface oil flow path R112.

On the other outer surface of the first partial coil assembly 153, namely on the surface of the partial coil 153*b* on the opposite side to the partial coil 153*a* (surface on the right side of FIG. 17), a second inter-coil insulating plate 162 is disposed with a space from the partial coil 153*b*. On the surface of the second inter-coil insulating plate 162 on the partial coil 153*b* side, a plurality of second inter-coil spacer insulators 161 are disposed with spaces.

The plurality of second inter-coil spacer insulators 161 are disposed between the second inter-coil insulating plate 162 and the partial coil 153*b*. The space between the adjacent second inter-coil spacer insulators 161 in the region between the second inter-coil insulating plate 162 and the partial coil 153*b* is a coil surface oil flow path R113.

Between the first partial coil assembly 153 and the second partial coil assembly 154, a plurality of inter-coil-assembly insulators 163 are disposed with spaces. The plurality of inter-coil-assembly insulators 163 form together an inter-coil-assembly oil flow path R114 between the first partial coil assembly 153 and the second partial coil assembly 154.

The inner circumference sides of the partial coils 153*a*, 153*b*, 154*a*, and 154*b* in the coil body 151 are connected as follows. First, the partial coil 153*b* close to the second partial coil assembly 154 out of the partial coils 153*a* and 153*b*, and the partial coil 154*a* close to the first partial coil assembly 153 out of the partial coils 154*a* and 154*b* are connected via a partial coil connection wire 166*b* of the inner circumference side.

In addition, the partial coil 153*a* distant from the second partial coil assembly 154 out of the partial coils 153*a* and 153*b* and the partial coil 154*b* distant from the first partial coil assembly 153 out of the partial coils 154*a* and 154*b* are connected via a partial coil connection wire 166*a* of the inner circumference side. The partial coil connection wires 166*a* and 166*b* of the inner circumference side constitute an adjacent reference connection portion 1166 similar to the above-mentioned adjacent reference connection portion 1126.

Similarly, the inner circumference sides of the partial coils 155*a*, 155*b*, 156*a*, and 156*b* in the coil body 151 are connected as follows. First, the partial coil 155*b* close to the fourth partial coil assembly 156 out of the partial coils 155*a* and 155*b*, and the partial coil 156*a* close to the third partial coil assembly 155 out of the partial coils 156*a* and 156*b* are connected via a partial coil connection wire 167*b* of the inner circumference side.

In addition, the partial coil 155*a* distant from the fourth partial coil assembly 156 out of the partial coils 155*a* and 155*b*, and the partial coil 156*b* distant from the third partial coil assembly 155 out of the partial coils 156*a* and 156*b* are connected via a partial coil connection wire 167*a* of the inner circumference side. The partial coil connection wires 167*a* and 167*b* of the inner circumference side constitute an adjacent reference connection portion 1167 similar to the above-mentioned adjacent reference connection portion 1127.

The outer periphery sides of the partial coils 153*a* and 153*b* in the coil body 151 are short-circuited via a partial coil connection wire 169*a* of the outer periphery side. Similarly to this, the outer periphery sides of the partial coils 156*a* and 156*b* are short-circuited via a partial coil connection wire 169*b* of the outer periphery side. The partial coil connection wires 169*a* and 169*b* of the outer periphery side form a simple connection portion 1169 similar to the above-mentioned simple connection portion 1129.

The outer periphery sides of the partial coils 154*a*, 154*b*, 155*a*, and 155*b* in the coil body 151 are connected as follows. First, the partial coil 154*b* close to the third partial coil assembly 155 out of the partial coils 154*a* and 154*b*, and the partial coil 155*b* distant from the second partial coil assembly 154 out of the partial coils 155*a* and 155*b* are connected via a partial coil connection wire 164*b* of the outer periphery side.

In addition, the partial coil 154*a* distant from the third partial coil assembly 155 out of the partial coils 154*a* and 154*b*, and the partial coil 155*a* close to the second partial coil assembly 154 out of the partial coils 155*a* and 155*b* are connected via a partial coil connection wire 164*a* of the outer periphery side. The partial coil connection wires 164*a* and 164*b* of the outer periphery side constitute a spool reference connection portion 1164 similar to the above-mentioned spool reference connection portion 1124.

When the above-mentioned connection is performed, the partial coils 153*a*, 154*b*, 155*b*, and 156*a* are connected in series to constitute a partial coil column 168*a*. Similarly, the partial coils 153*b*, 154*a*, 155*a*, and 156*b* are connected in series to constitute a partial coil column 168*b*. Therefore, also in the above-mentioned shell type transformer 141 of the fifth embodiment, similarly to the fourth embodiment, the induced electromotive force generated in the partial coil column 168*a* and the induced electromotive force generated in the partial coil column 168*b* due to the leakage flux are canceled by each other so that cyclic current is reduced. Therefore, increase of loss can be suppressed similarly to the core type transformer 101 of the fourth embodiment.

In addition, also in the shell type transformer, similarly to the case of the above-mentioned core type transformer, if the partial coil column is constituted of 4n (n denotes an integer of 1 or larger) partial coils, the above-mentioned cyclic current reducing effect can be obtained by performing connection as follows.

The partial coils belonging to the first partial coil assembly are short-circuited at the outer periphery side by the simple connection portion. Similarly, the partial coils belonging to the 4n-th partial coil assembly are short-circuited at the outer periphery side by the simple connection portion.

Next, the (2+4k)th (k denotes a positive integer from 1 to n−1 or zero) partial coil assembly and the (3+4k)th partial coil assembly are connected at the outer periphery side by the spool reference connection portion.

The (4+4m)th (m denotes a positive integer of 1 to n−2 or zero) partial coil assembly and the (5+4m)th partial coil assembly are connected at the outer periphery side by one of the following three connection methods:

(1) connecting by the spool reference connection portion;

(2) connecting by the adjacent reference connection portion; and (3) short-circuiting the partial coils belonging to the (4+4m)th partial coil assembly, short-circuiting the partial coils belonging to the (5+4m)th partial coil assembly, and further connecting the (4+4m)th partial coil assembly and the (5+4m)th partial coil assembly to each other.

As to the inner circumference side, it is supposed that the partial coils belonging to the (j−1)th (j denotes an even number of 2 to 4n) partial coil assembly and the partial coils belonging to the j-th partial coil assembly are connected by the adjacent reference connection portion.

In addition, also in the case where the partial coil column is constituted of 4n+1 to 4n+3 (n denotes an integer of 1 or larger) partial coils, a potential difference generated between the two partial coil columns can be reduced, and the cyclic current can be reduced so as to suppress increase of loss for at least 4n partial coils, by the same connection as the case where the partial coil column is constituted of 4n partial coils.

Note that, even with a structure in which the positional relationship between the inner circumference and the outer periphery of the above-mentioned connection is reversed in the fifth embodiment, the same effect as the fifth embodiment can be obtained.

Sixth Embodiment

In the fourth embodiment, the two partial coils constitute one partial coil assembly. The present invention is not limited to this, and one partial coil assembly may be constituted of P partial coils. A sixth embodiment of the present invention describes an example in which three partial coils constitute one partial coil assembly.

Figure 18:
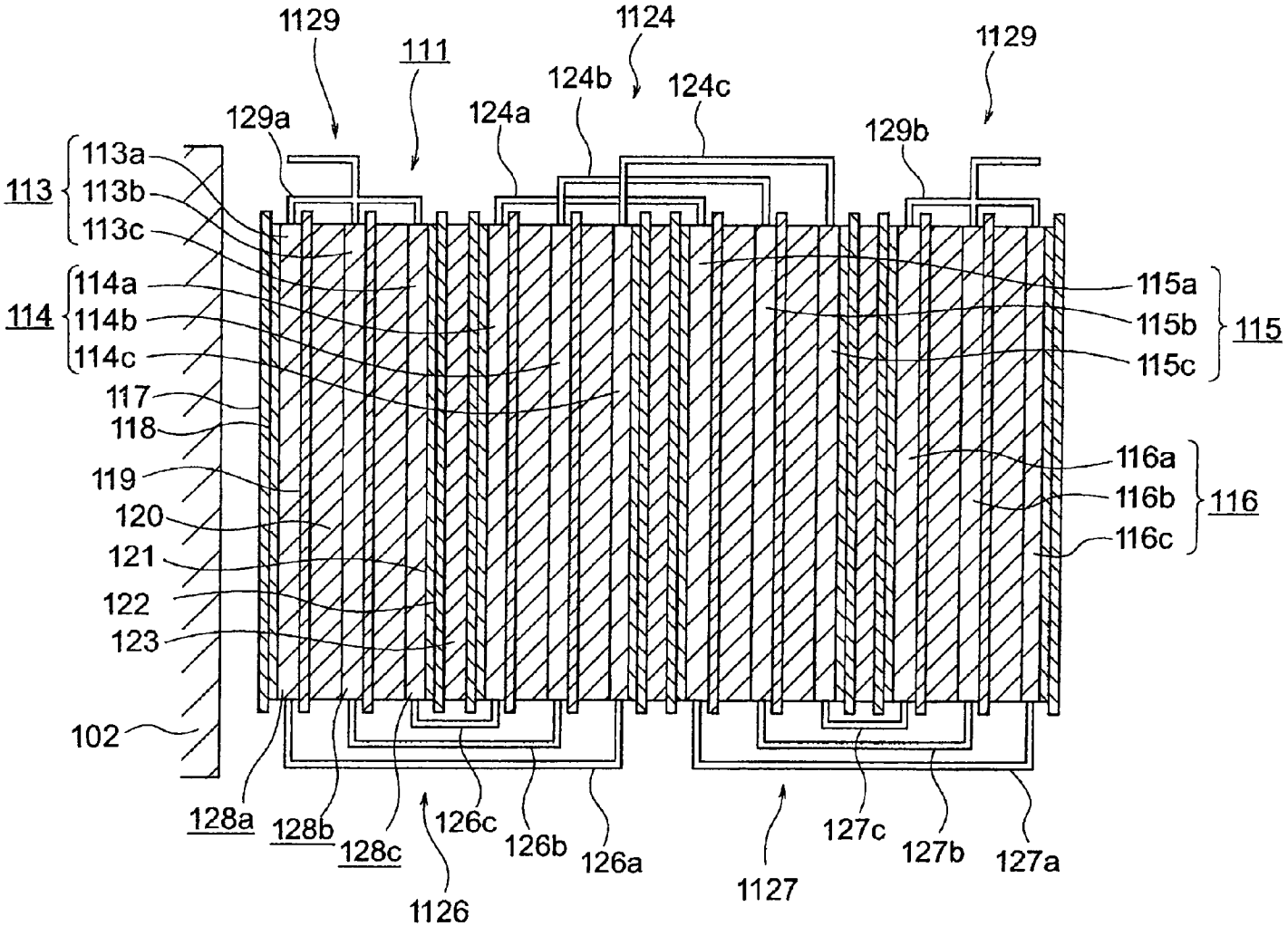
FIG. 18 is a cross-sectional view illustrating a main part of a core type transformer in an enlarged manner according to a sixth embodiment of the present invention.

FIG. 18 is a cross-sectional view illustrating a main part of the core type transformer 101 according to the sixth embodiment of the present invention in an enlarged manner, which corresponds to FIG. 13 of the fourth embodiment.

As illustrated in FIG. 18, in this example, a plurality of partial coil assemblies including four partial coil assemblies 113, 114, 115, and 116 are disposed, and each of the four partial coil assemblies 113, 114, 115, and 116 includes three partial coils 113*a* to 113*c*, 114*a* to 114*c*, 115*a* to 115*c*, or 116*a* to 116*c*. Therefore, there are three partial coil columns 128*a* to 128*c*, and the simple connection portion 1129 includes a trifurcated coil connection wires 129*a* and 129*b*. Further, the spool reference connection portion 1124 also includes three coil connection wires 124*a* to 124*c*. In addition, the adjacent reference connection portions 1126 and 1127 also include three coil connection wires 126*a* to 126*c* and 127*a* to 127*c*, respectively.

Further, accompanying the above description, two partial coil surface oil flow paths (refrigerant flow paths) are disposed for each of the partial coil assemblies, namely between the inner partial coil and the intermediate partial coil, and between the intermediate partial coil and the outer partial coil.

The partial coils 113*a*, 113*b*, and 113*c* belonging to the first partial coil assembly 113 are short-circuited at the upper end side of the coil body 111 by the partial coil connection wire 129*a* of the upper end side constituting the simple connection portion 1129. Similarly, the partial coils 116*a*, 116*b*, and 116*c* belonging to the fourth partial coil assembly 116 are short-circuited at the upper end side of the coil body 111 by the partial coil connection wire 129*b* of the upper end side constituting the simple connection portion 1129.

The partial coil 114*a*, 114*b*, and 114*c* belonging to the second partial coil assembly 114, and the partial coils 115*a* and 115*b*, 115*c* belonging to the third partial coil assembly 115 are connected at the upper end side of the coil body 111 by the spool reference connection portion 1124. Therefore, specifically, in view of each partial coil assembly, the partial coil 114*a* and the partial coil 115*a*, which are closest to the spool, are connected by the coil connection wire 124*a*. The partial coil 114*b* and the partial coil 115*b*, which are next closest to the spool, are connected by the coil connection wire 124*b*. Further, the partial coil 114*c* and the partial coil 115*c*, which are next closest to the spool, are connected by the coil connection wire 124*c*.

The partial coils 113*a*, 113*b*, and 113*c* belonging to the first partial coil assembly 113, and the partial coils 114*a*, 114*b*, and 114*c* belonging to the second partial coil assembly 114 are connected at the lower end side of the coil body 111 by the adjacent reference connection portion 1126. Similarly, the partial coils 115*a*, 115*b*, and 115*c* belonging to the third partial coil assembly 115, and the partial coils 116*a*, 116*b*, and 116*c* belonging to the fourth partial coil assembly 116 are connected at the upper end side of the coil body 111 by the adjacent reference connection portion 1127.

Specifically, in view of a relationship between the first partial coil assembly 113 and the second partial coil assembly 114, the partial coil 113*c* and the partial coil 114*a*, which are closest to each other, are connected by the coil connection wire 126*c*. The partial coil 113*b* and the partial coil 114*b*, which are next closest to each other, are connected by the coil connection wire 126*b*. Further, the partial coil 113*a* and the partial coil 114*c*, which are next closest to each other, are connected by the coil connection wire 126*a*.

Similarly, in view of a relationship between the third partial coil assembly 115 and the fourth partial coil assembly 116, the partial coil 115*c* and the partial coil 116*a*, which are closest to each other, are connected by the coil connection wire 127*c*. The partial coil 115*b* and the partial coil 116*b*, which are next closest to each other, are connected by the coil connection wire 127*b*. Further, the partial coil 115*a* and the partial coil 116*c*, which are next closest to each other, are connected by the coil connection wire 127*a*.

When the above-mentioned connecting is performed, the partial coils 113*a*, 114*c*, 115*c*, and 116*a* are connected in series to form the partial coil column 128*a*. Similarly, the partial coils 113*b*, 114*b*, 115*b*, and 116*b* are connected in series to form the partial coil column 128*b*. The partial coils 113*c*, 114*a*, 115*a*, and 116*c* are connected in series to form the partial coil column 128*c*.

The core type transformer 101 of the sixth embodiment having the structure described above also enables that induced electromotive forces generated by leakage flux are canceled by each other, and that increase of loss can be suppressed similarly to the core type transformer 101 of the fourth embodiment.

Note that, the sixth embodiment describes the core type transformer 101. However, as to the shell type transformer of the fifth embodiment, too, P partial coils (P denotes an integer of three or larger) can constitute one partial coil assembly in general, and increase of loss due to the cyclic current can be suppressed similarly to the sixth embodiment.

In addition, the first, second, and fifth embodiments describe the shell type transformers 1 and 141, and the third, fourth, and sixth embodiments describe the core type transformers 31 and 101 as the stationary induction apparatus. However, the present invention can be applied also to an oil-filled reactor, for example.

In addition, the fourth to sixth embodiments describe the structures including four or more partial coil assemblies performing specific connections, and thus exemplify the case where a total potential difference among a plurality of partial coil columns connected in series becomes almost zero. However, the present invention is sufficient if at least one spool reference connection portion is disposed at one end of the partial coil assembly, and at least one adjacent reference connection portion is disposed at the other end. Thus, partial coil assemblies in which a positive induced electromotive force is generated and partial coil assemblies in which a negative induced electromotive force is generated are mixed. Thus, a canceling effect works so that a total potential difference between partial coil columns is reduced. Therefore, it is possible to adopt a structure including three partial coil assemblies performing a specific connection.

Further, as to the support structure of the partial coils in the fourth to sixth embodiments, it is possible to use the partial coil support structure of the partial coils described in the first to third embodiments. For instance, similarly to the inter-partial-coil insulating plates 10, 20, and 40 in the first to third embodiments, the inter-partial-coil insulating plates 119 and 159 may be provided with an opening communicating to the partial coil surface oil flow path (refrigerant flow path).

The invention claimed is:

1. A stationary induction apparatus having a partial coil assembly constituted of a plurality of partial coils disposed to be opposed and to overlap with each other, comprising:

refrigerant flow paths formed on both sides of each of the plurality of partial coils; and an inter-partial-coil supporting portion that is disposed between adjacent partial coils to cover an entire overlapping region between the adjacent partial coils, supports each of the adjacent partial coils in an insulated state so that a space is secured between the adjacent partial coils, and forms one of the refrigerant flow paths between the adjacent partial coils, wherein the inter-partial-coil supporting portion has a first surface that is opposed to one of the adjacent partial coils, and a second surface that is a surface opposite to the first surface and is opposed to another one of the adjacent partial coils, wherein on at least one of the first surface and the second surface of the inter-partial-coil supporting portion, there are a plurality of inter-partial-coil protrusions which are disposed to protrude from the at least one of the first surface and the second surface, and which are disposed with spaces for forming one of the refrigerant flow paths together, wherein between the inter-partial-coil protrusions of the inter-partial-coil supporting portion, there are formed a plurality of openings communicating to the one of the refrigerant flow paths for guiding a refrigerant to the outer surface of the partial coil, a plurality of openings cover the entire overlapping region between the adjacent partial coils.

2. A stationary induction apparatus according to claim 1, wherein:

the partial coil assembly comprises 4n partial coil assemblies disposed to be adjacent continuously, where n denotes a positive integer;

on one end of the partial coil assembly, the plurality of partial coils belonging to a first partial coil assembly are connected to each other, and the plurality of partial coils belonging to a 4n-th partial coil assembly are connected to each other;

the plurality of partial coils belonging to a (2+4k)th partial coil assembly and the plurality of partial coils belonging to a (3+4k)th partial coil assembly are connected by the at least one spool reference connection portion, where k denotes a positive integer of 1 to n−1 or zero, the spool reference connection portion connects the plurality of partial coils belonging to one of an adjacent pair of the adjacent partial coil assemblies to the plurality of partial coils belonging to another one of the adjacent pair of the adjacent partial coil assemblies, in order from partial coils closer to a spool;

a connection between the plurality of partial coils belonging to a (4+4m)th partial coil assembly and the plurality of partial coils belong to a (5+4m)th partial coil assembly, where m denotes a positive integer of 1 to n−2 or zero, is performed by one of the following methods:

(1) connecting by the at least one spool reference connection portion;

(2) connecting by the at least one adjacent reference connection portion which connects the plurality of partial coils belonging to one of an adjacent pair of the adjacent partial coil assemblies to the plurality of partial coils belonging to another one of the adjacent pair of the adjacent partial coil assemblies, in order from partial coils closer to each other; and (3) connecting the plurality of partial coils belonging to the (4+4m)th partial coil assembly to each other, connecting the plurality of partial coils belonging to the (5+4m)th partial coil assembly to each other, and further connecting the (4+4m)th partial coil assembly and the (5+4m)th partial coil assembly to each other; and on another end of the partial coil assembly, the plurality of partial coils belonging to a (j−1)th partial coil assembly and the plurality of partial coils belonging to a j-th partial coil assembly are connected by the at least one adjacent reference connection portion, where j denotes an even number of 2 to 4n.

3. A stationary induction apparatus according to claim 2, wherein:

the first surface contacts with an outer surface of one of the adjacent partial coils; and on the second surface of the inter-partial-coil supporting portion, there are a plurality of inter-partial-coil protrusions which contact with an outer surface of another one of the adjacent partial coils.

4. A stationary induction apparatus according to claim 3, wherein between the inter-partial-coil protrusions of the inter-partial-coil supporting portion, there is formed an opening communicating to each of the refrigerant flow paths for guiding a refrigerant to the outer surfaces of the plurality of partial coils.

5. A stationary induction apparatus according to claim 2, wherein the plurality of inter-partial-coil protrusions disposed on the first surface and the second surface of the inter-partial-coil supporting portion are disposed to overlap across the inter-partial-coil supporting portion in a direction in which the partial coils are opposed to each other.

6. A stationary induction apparatus according to claim 5, wherein between the inter-partial-coil protrusions of the inter-partial-coil supporting portion, there is formed an opening communicating to each of the refrigerant flow paths for guiding a refrigerant to the outer surfaces of the plurality of partial coils.

7. A stationary induction apparatus according to claim 1, wherein:

the first surface contacts with an outer surface of one of the adjacent partial coils; and on the second surface of the inter-partial-coil supporting portion, there are a plurality of inter-partial-coil protrusions which contact with an outer surface of another one of the adjacent partial coils.

8. A stationary induction apparatus according to claim 7, wherein between the inter-partial-coil protrusions of the inter-partial-coil supporting portion, there is formed an opening communicating to each of the refrigerant flow paths for guiding a refrigerant to the outer surfaces of the plurality of partial coils.

9. A stationary induction apparatus according to claim 1, wherein the plurality of inter-partial-coil protrusions disposed on the first surface and the second surface of the inter-partial-coil supporting portion are disposed to overlap across the inter-partial-coil supporting portion in a direction in which the partial coils are opposed to each other.

10. A stationary induction apparatus according to claim 9, wherein between the inter-partial-coil protrusions of the inter-partial-coil supporting portion, there is formed an opening communicating to each of the refrigerant flow paths for guiding a refrigerant to the outer surfaces of the plurality of partial coils.

* * * * *